US010991286B2

(12) United States Patent
Hosaka

(10) Patent No.: US 10,991,286 B2
(45) Date of Patent: Apr. 27, 2021

(54) ELECTRO-OPTICAL DEVICE INCLUDING A LIGHT PATH SHIFTING ELEMENT AND METHOD FOR CONTROLLING THE SAME

(71) Applicant: SEIKO EPSON CORPORATION, Tokyo (JP)

(72) Inventor: Hiroyuki Hosaka, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/580,017

(22) Filed: Sep. 24, 2019

(65) Prior Publication Data

US 2020/0098295 A1 Mar. 26, 2020

(30) Foreign Application Priority Data

Sep. 25, 2018 (JP) ..... JP2018-179102

(51) Int. Cl.

| | |
|---|---|
| ***G09G 5/10*** | (2006.01) |
| ***G09G 3/00*** | (2006.01) |
| ***G09G 3/20*** | (2006.01) |
| ***G09G 3/36*** | (2006.01) |

(52) U.S. Cl.

CPC ..... *G09G 3/007* (2013.01); *G09G 3/2022* (2013.01); *G09G 3/3607* (2013.01); *G09G 3/3614* (2013.01); *G09G 2340/0407* (2013.01)

(58) Field of Classification Search

None

See application file for complete search history.

(56) References Cited

U.S. PATENT DOCUMENTS

2003/0107538 A1* 6/2003 Asao ..... G09G 3/3413 345/87
2004/0207815 A1* 10/2004 Allen ..... G09G 3/007 353/31
2005/0069209 A1* 3/2005 Damera-Venkata ..... G09G 5/391 382/204
2005/0157272 A1* 7/2005 Childers ..... G09G 3/007 353/84

(Continued)

FOREIGN PATENT DOCUMENTS

JP H04-063332 A 2/1992
JP 2007-241097 A 9/2007

(Continued)

*Primary Examiner* — Kirk W Hermann
(74) *Attorney, Agent, or Firm* — Oliff PLC

(57) ABSTRACT

A projector includes a liquid crystal panel including a predetermined pixel, a light path shifting element changing a light path of light emitted via the predetermined pixel so that a first region in a display surface in a first unit period and a second region in the display surface in a second unit period partially overlap, and a control unit displaying an image corresponding to a first pixel information on the predetermined pixel in one subfield period within the first unit period, displaying an image corresponding to a second pixel information on the predetermined pixel in another subfield period within the first unit period, displaying an image corresponding to the second pixel information on the predetermined pixel in one subfield period within the second unit period, and displaying an image corresponding to a third pixel information on the predetermined pixel in another subfield period of the second unit period.

8 Claims, 18 Drawing Sheets

(56) References Cited

U.S. PATENT DOCUMENTS

| | | | | |
|---|---|---|---|---|
| 2007/0097334 | A1* | 5/2007 | Damera-Venkata | H04N 9/3147 353/94 |
| 2010/0214646 | A1* | 8/2010 | Sugimoto | H04N 9/3105 359/292 |
| 2011/0090465 | A1 | 4/2011 | Watanabe et al. | |
| 2015/0219983 | A1* | 8/2015 | Mashitani | G03B 21/142 353/31 |
| 2020/0090565 | A1* | 3/2020 | Sawahata | G09G 3/3648 |

FOREIGN PATENT DOCUMENTS

| | | | |
|---|---|---|---|
| JP | 2011-090098 | A | 5/2011 |
| JP | 2012-013766 | A | 1/2012 |
| JP | 2014-110584 | A | 6/2014 |

* cited by examiner

ELECTRO-OPTICAL DEVICE INCLUDING A LIGHT PATH SHIFTING ELEMENT AND METHOD FOR CONTROLLING THE SAME

The present application is based on, and claims priority from JP Application Serial Number 2018-179102, filed Sep. 25, 2018, the disclosure of which is hereby incorporated by reference herein in its entirety.

BACKGROUND

1. Technical Field

The present disclosure relates to an electro-optical device and a method for controlling the same.

2. Related Art

A so-called pixel shifting technique that increases resolution in a pseudo manner has been known. JP-A-2014-110584 discloses an electro-optical device that divides one frame into a plurality of unit periods, and controls a polarized light direction so that a state in which pixels are shifted to perform pixel shifting is changed for each unit period. This electro-optical device displays a first image at a first position in one unit period, and displays a second image at a second position after pixels are subjected to the pixel shifting by 0.5 pixels in a 135 degree direction in a next unit period.

In the pixel shifting by 0.5 pixels, in the one unit period and the next unit period, the first image and the second image overlap on a display surface, so a gray scale level of an overlapping region is an average value of a gray scale level of the first image and a gray scale level of the second image. In such a display method, in a case of so-called one-dot display in which a gray scale level of one pixel is black and a gray scale level of peripheral pixels is white, since the one dot focused has a gray scale level obtained by averaging a white level and a black level, there is a problem that fine display cannot be achieved.

SUMMARY

In order to solve the above-described problem, an electro-optical device according to an aspect of the present disclosure includes an electro-optical panel in which a plurality of pixels including a predetermined pixel are arranged, a light path shifting element configured to change a light path of light emitted via the predetermined pixel so that a first region in which the light reaches a display surface in a first unit period including $\alpha$ subfield periods ($\alpha$ is an integer satisfying $2 \leq \alpha$) and a second region in which the light reaches the display surface in a second unit period including $\alpha$ subfield periods partially overlap, and a control unit configured to, based on a first pixel information indicating a gray scale level of a first pixel, a second pixel information indicating a gray scale level of a second pixel, and a third pixel information indicating a gray scale level of a third pixel, display, on the predetermined pixel, an image corresponding to the first pixel information in one subfield period within the first unit period, display, on the predetermined pixel, an image corresponding to the second pixel information in another subfield period within the first unit period, display, on the predetermined pixel, an image corresponding to the second pixel information in one subfield period within the second unit period, and display, on the predetermined pixel, an image corresponding to the third pixel information in another subfield period within the second unit period.

Further, in order to solve the above-described problem, an electro-optical device according to another aspect of the present disclosure includes an electro-optical panel in which a plurality of pixels including a predetermined pixel are arranged, a light path shifting element configured to change a light path of light emitted via the predetermined pixel so that a first region in which the light reaches a display surface in a first unit period including $\alpha$ subfield periods ($\alpha$ is an integer satisfying $2 \leq \alpha$) and a second region in which the light reaches the display surface in a second unit period including $\alpha$ subfield periods partially overlap, and a control unit configured to, based on a first pixel information representing a gray scale level of a first pixel, a second pixel information representing a gray scale level of a second pixel, and a third pixel information representing a gray scale level of a third pixel, display, on the predetermined pixel, an image corresponding to an average value of a gray scale level of the first pixel information and a gray scale level of the second pixel information in one subfield period within the first unit period and in another subfield period within the first unit period, and display, on the predetermined pixel, an image corresponding to an average value of a gray scale level of the second pixel information and a gray scale level of the third pixel information in one subfield period within the second unit period and in another sub-field period within the second unit period.

Further, in order to solve the above-described problem, a method for controlling an electro-optical device according to another aspect of the present disclosure is a method for controlling an electro-optical device including an electro-optical panel in which a plurality of pixels including a predetermined pixel are arranged, the method including changing a light path of light emitted via the predetermined pixel so that a first region in which the light reaches a display surface in a first unit period including $\alpha$ subfield periods ($\alpha$ is an integer satisfying $2 \leq \alpha$) and a second region in which the light reaches the display surface in a second unit period including $\alpha$ subfield periods partially overlap, and based on a first pixel information representing a gray scale level of a first pixel, a second pixel information representing a gray scale level of a second pixel, and a third pixel information representing a gray scale level of a third pixel, displaying, on the predetermined pixel, an image corresponding to the first pixel information in one subfield period within the first unit period, displaying, on the predetermined pixel, an image corresponding to the second pixel information in another subfield period within the first unit period, displaying, on the predetermined pixel, an image corresponding to the second pixel information in one subfield period within the second unit period, and displaying, on the predetermined pixel, an image corresponding to the third pixel information in another subfield period within the second unit period.

Further, in order to solve the above-described problem, a method for controlling an electro-optical device according to another aspect of the present disclosure is a method for controlling an electro-optical device including an electro-optical panel in which a plurality of pixels including a predetermined pixel are arranged, the method including changing a light path of light emitted via the predetermined pixel so that a first region in which the light reaches a display surface in a first unit period including $\alpha$ subfield periods ($\alpha$ is an integer satisfying $2 \leq \alpha$) and a second region in which the light reaches the display surface in a second unit period including $\alpha$ subfield periods partially overlap, and based on a first pixel information representing a gray scale level of a first pixel, a second pixel information representing a gray scale level of a second pixel, and a third pixel information representing a gray scale level of a third pixel, displaying, on the predetermined pixel, an image corresponding to an average value of a gray scale level of the first pixel information and a gray scale level of the second pixel information in one subfield period within the first unit period and in another subfield period within the first unit period, and displaying, on the predetermined pixel, an image corresponding to an average value of a gray scale level of the second pixel information and a gray scale level of the third pixel information in one subfield period within the second unit period and in another subfield period within the second unit period.

DESCRIPTION OF EXEMPLARY EMBODIMENTS

Hereinafter, modes for carrying out the present disclosure will be described with reference to accompanying drawings. However, in each drawing, a size and scale of each portion is different from the actual size and scale of each portion as appropriate. Moreover, exemplary embodiments described below are suitable specific examples of the disclosure, and various technically preferable limitations are applied, but the scope of the disclosure is not limited to these modes unless it is specifically described in the following description to limit the disclosure.

1. First Embodiment

1.1. Configuration of Projector

A configuration example of a projector 1 according to an embodiment of the present disclosure will be described with reference to FIG. 1. The projector 1 is an example of an electro-optical device. An electro-optical device is a device in which optical characteristics are changed by electrical energy. A typical example of the electro-optical device is a liquid crystal apparatus.

Figure 1:
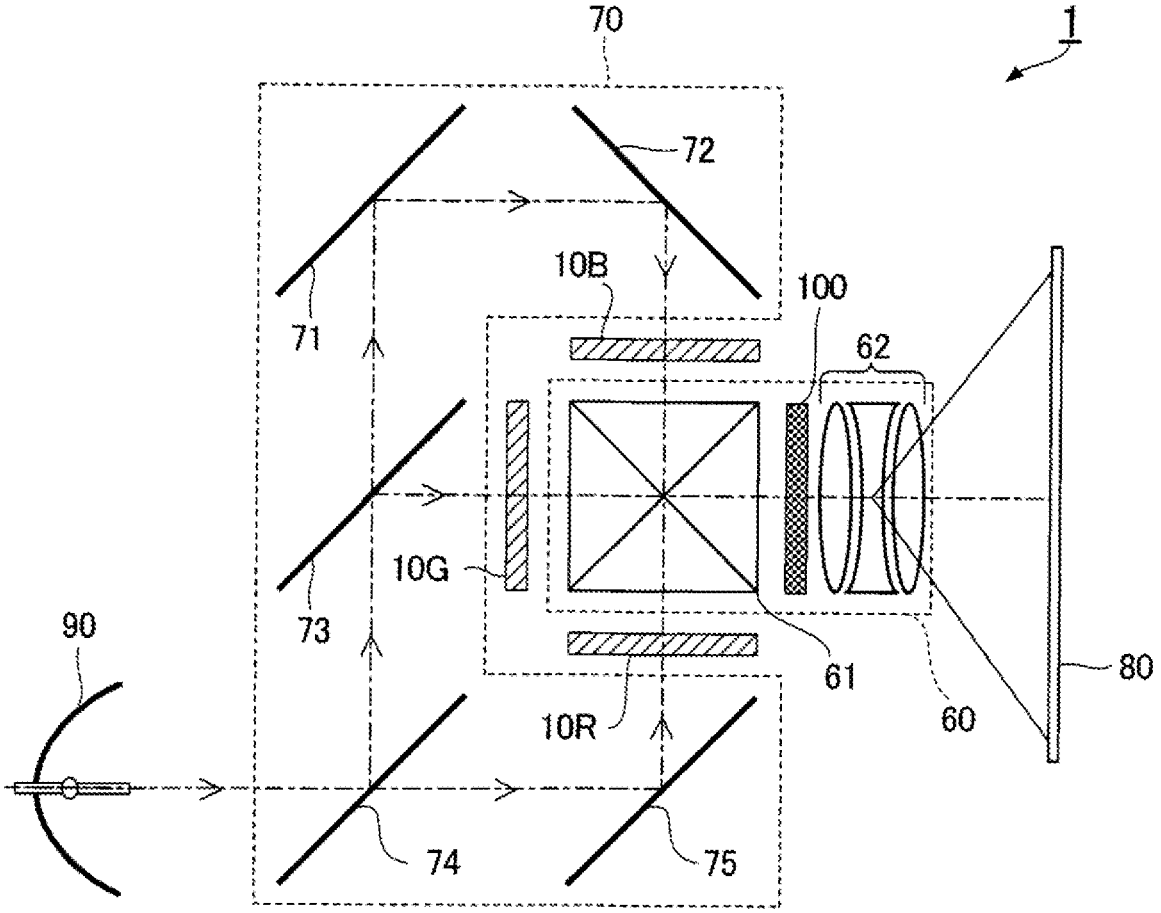
FIG. 1 is an explanatory diagram illustrating an example of a configuration of an optical system of a projector according to the present disclosure.

FIG. 1 is a block diagram illustrating an example of a configuration of an optical system of the projector 1. The projector 1 includes an illumination device 90, a separation optical system 70, three liquid crystal panels 10R, 10G, and 10B, and a projection optical system 60. The illumination device 90 is a white light source, and for example, a halogen lamp is used therefor. The separation optical system 70 includes three mirrors 71, 72, and 75 and dichroic mirrors 73 and 74. The separation optical system 70 separates white light emitted from the illumination device 90 into three primary colors of red, green, and blue. In the following description, red is referred to as "R", green is referred to as "G", and blue is referred to as "B". Specifically, the dichroic mirror 74 transmits light in a wavelength band of R of white light and reflects light in wavelength bands of G and B. The dichroic mirror 73 transmits light in the wavelength band of B of the light in the wavelength bands of G and B reflected by the dichroic mirror 74, and reflects the light in the wavelength range of G.

Respective beams of light corresponding to R, G, and B separated as described above are directed to the liquid crystal panels 10R, 10G and 10B. The liquid crystal panels 10R, 10G and 10B are used as spatial light modulators. Note that, in the following, the liquid crystal panels 10R, 10G and 10B are collectively referred to as liquid crystal panels 10 in some cases.

The projection optical system 60 includes a dichroic prism 61, a projection lens system 62, and a light path shifting element 100. The beams of light modulated by the respective liquid crystal panels 10R, 10G, and 10B are incident on the dichroic prism 61 from three directions. In this dichroic prism 61, respective images of R, G, and B are synthesized, and full color light is emitted.

The light path shifting element 100 and the projection lens system 62 are disposed on a side of the dichroic prism 61 from which light is emitted. The light path shifting element 100 is an element that shifts incident light from one to another direction of two predetermined directions, or shifts the incident light from the other to the one direction, and emits it. The projection lens system 62 enlarges and projects the light (synthesized image) emitted from the light path shifting element 100 onto a screen 80. An image is displayed on a display surface of the screen 80.

Figure 2:
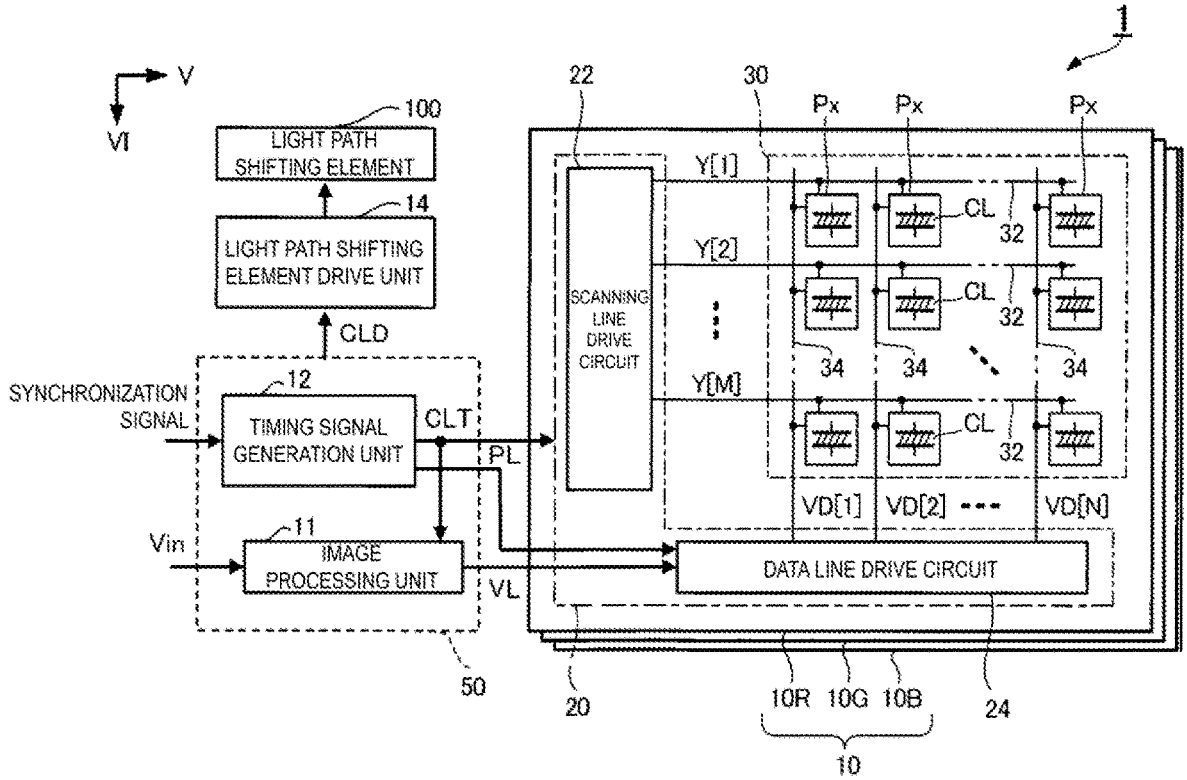
FIG. 2 is a block diagram illustrating a configuration example of a control system of the projector.

FIG. 2 is a block diagram illustrating a configuration example of a control system of the projector 1. The projector 1 includes the three liquid crystal panels 10, a control unit 50, a light path shifting element drive unit 14, and the light path shifting element 100. The liquid crystal panel 10 includes a display unit 30 in which a plurality of unit pixels Px are arranged, and a drive circuit 20 that drives each of the unit pixels Px. The unit pixel Px is an example of a pixel.

As illustrated in FIG. 2, M scan lines 32 extending in a V direction and N data lines 34 extending in a VI direction intersecting with the V direction are formed in the display unit 30 of the liquid crystal panel 10. In this case, M and N are integers. The plurality of unit pixels Px are arranged in vertical M rows by horizontal N columns corresponding to intersection points of the scan lines 32 and the data lines 34 in the display unit 30. Note that, in the present embodiment, the unit pixel Px is disposed at all M×N intersection points by the M scan lines 32 and the N data lines 34, but may be disposed in some of the M×N intersections. Resolution of the liquid crystal panel 10 is defined by the number of the unit pixels Px included in the liquid crystal panel 10.

The drive circuit 20 is a circuit for supplying a data signal VD[n] specifying a gray scale level displayed by each of the unit pixels Px to pixel circuits 40 provided in the respective unit pixels Px, and includes a scan line drive circuit 22 and a data line drive circuit 24. In this case, n is an integer satisfying $1 \leq n \leq N$.

The scan line drive circuit 22 supplies a scan signal Y[m] to the scan lines 32 in an m-th row. The scan line drive circuit 22 selects the scan line 32 in the m-th row by setting the scan signal Y[m] to a predetermined selective potential. In this case, m is an integer satisfying $1 \leq m \leq M$.

The data line drive circuit 24 supplies data signals VD[1] to VD[N] to the data lines 34 in a first to N-th rows respectively in synchronization with selection of the scan lines 32 by the scan line drive circuit 22. In other words, the data line drive circuit 24 supplies the data signal VD[n] to the data line in an n-th row.

Figure 3:
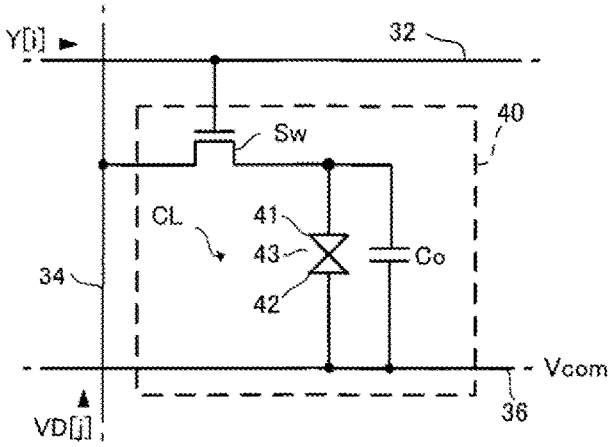
FIG. 3 is a circuit diagram of a pixel circuit corresponding to each unit pixel.

FIG. 3 is a circuit diagram of the pixel circuit 40 corresponding to each of the unit pixels Px. As illustrated in FIG. 3, each of the pixel circuits 40 includes a liquid crystal element CL, a selective switch Sw, and capacitance Co.

The liquid crystal element CL is an electro-optical element that includes a pixel electrode 41, a common electrode 42, and a liquid crystal 43 provided between the pixel electrode 41 and the common electrode 42. When a voltage is applied to the liquid crystal element CL, that is, between the pixel electrode 41 and the common electrode 42, relative transmittance of the liquid crystal element CL is changed in accordance with magnitude of the applied voltage. Further, the unit pixel Px displays a gray scale level in accordance with the relative transmittance of the liquid crystal element CL.

Here, the relative transmittance of the liquid crystal element CL is a relative value indicating an amount of light transmitting through the liquid crystal element CL. In the present embodiment, an amount of light transmitting through the liquid crystal element CL in a state in which a voltage is not applied to the liquid crystal element CL, and the liquid crystal 43 is in a state in which the liquid crystal 43 is most difficult to transmit light is defined as 0%. In addition, an amount of light transmitting through the liquid crystal element CL in a state in which an applicable maximum voltage is applied to the liquid crystal element CL, and the liquid crystal 43 is in a state of most easily transmitting light is defined as 100%. In the following, the relative transmittance of the liquid crystal element CL may be simply referred to as "transmittance".

Note that, in the present embodiment, a case will be exemplified and described in which the liquid crystal 43 included in the liquid crystal element CL adopts a Vertical Alignment (VA) scheme, and is in a normally black mode in which the unit pixel Px is displayed in black in a state in which a voltage is not applied between the pixel electrode 41 and the common electrode 42. Being displayed in black means that the relative transmittance of the liquid crystal element CL is 0%.

The common electrode 42 is set to a predetermined reference potential. One end of the capacitance Co is electrically coupled with the pixel electrode 41, and another end is electrically coupled with a capacitance line 36 for which a constant voltage VHom is maintained. Further, the common electrode 42 is also electrically coupled with the capacitance line 36.

The selective switch Sw, for example, is an N-channel type transistor, is provided between the pixel electrode 41 and the data line 34, and controls conduction or insulation that is an electrical coupling state of the two. Specifically, a gate of the selective switch Sw being an N-channel type transistor is electrically coupled with the scan line 32. Then, when the scan signal Y[m] is set to the selective potential, the selective switch Sw provided in the pixel circuit 40 in the m-th row is in an ON-state. When the selective switch Sw is in the ON-state, the data signal VD[n] is supplied to the pixel circuit 40 from the data line 34, and a voltage in accordance with the data signal VD[n] is applied to the liquid crystal element CL. Thus, the transmittance of the liquid crystal element CL of the pixel circuit 40 changes in accordance with the data signal VD[n], and the unit pixel Px corresponding to the pixel circuit 40 displays a gray scale level in accordance with the data signal VD[n].

After the voltage in accordance with the data signal VD[n] is applied to the liquid crystal element CL of the pixel circuit 40, potential at the pixel electrode 41 is held by the capacitance Co when the selective switch Sw is in an OFF-state. In other words, the voltage in accordance with the data signal VD[n] continues to be applied to the liquid crystal element CL in a period after the selective switch Sw is in the ON-state until the selective switch Sw is in the ON-state next. Note that, electrical characteristics of the liquid crystal element CL deteriorate when a DC voltage is applied, causing a so-called ghosting phenomenon. Thus, AC driving that inverts potential of the data signal VD[n] with predetermined potential being a center is employed. The predetermined potential is, for example, reference potential of the common electrode 42. Alternatively, potential for which a voltage drop due to a transistor of the selective switch Sw is taken into account is employed as the predetermined potential. Additionally, polarity in a case where the potential of the data signal VD[n] is higher than the predetermined potential is referred to as a positive polarity, and polarity in a case where the potential of the data signal VD[n] is lower than the predetermined potential is referred to as a negative polarity.

The description is returned to FIG. 2. The control unit 50 includes an image processing unit 11 and a timing signal generation unit 12. The timing signal generation unit 12 generates a control signal CLT for controlling the drive circuit 20 and the image processing unit 11 based on a synchronization signal supplied from a higher-level device (not illustrated), and supplies the control signal CLT generated to the drive circuit 20 and the image processing unit 11.

In addition, the timing signal generation unit 12 generates a polarity signal PL indicating polarity of the data signal VD[n] and supplies to the data line drive circuit 24. The data line drive circuit 24 sets the polarity of the data signal VD[n] in accordance with the polarity signal PL. Further, the timing signal generation unit 12 generates a control signal CLD for controlling the light path shifting element 100 based on the synchronization signal.

The image processing unit 11 generates, when an input image signal Vin representing an image to be displayed by the projector 1 is supplied from a higher-level device, based on the input image signal Vin and the control signal CLT supplied from the timing signal generation unit 12, an output image signal VL indicating a gray scale level of the unit pixel Px for each of a plurality of subfield periods sf (described later). Further, the image processing unit 11 generates a control signal CLU specifying the presence or absence of driving of the light path shifting element 100 based on the input image signal Vin, and supplies it to the light path shifting element drive unit 14. Note that, the input image signal Vin will be described in detail later.

The light path shifting element drive unit 14 drives the light path shifting element 100 based on the control signal CLD supplied from the timing signal generation unit 12 and the control signal CLU supplied from the image processing unit 11.

The light path shifting element 100 is driven based on a signal supplied from the light path shifting element drive unit 14. As described above, the light path shifting element 100 shifts the light path of the light incident on the light path shifting element 100.

1.2. Overview of Operation of Projector

Figure 4:
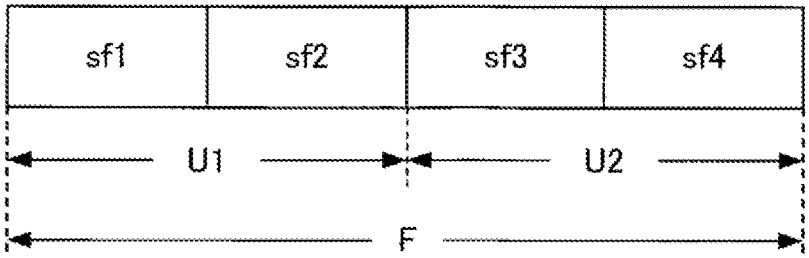
FIG. 4 is an explanatory diagram of an operating period of the projector.

FIG. 4 is an explanatory diagram of an operation period of the projector 1. In the present embodiment, the operation period of the projector 1 is constituted by a plurality of frame periods F. The frame period F is, when the projector 1 displays an image of one screen, a period for the unit pixel Px to display a gray scale level corresponding to the image. As illustrated in FIG. 4, in the present embodiment, the frame period F is divided into a first unit period U1 and a second unit period U2 that have mutually identical lengths of time. In addition, in the present embodiment, the first unit period U1 is a period that starts simultaneously when the frame period F starts, and the second unit period U2 is a period that follows the first unit period U1, and ends simultaneously with the frame period F. Note that, hereinafter, the first unit period U1 and the second unit period U2 may be collectively referred to as unit periods U.

In the present embodiment, each of the unit periods U is divided into $\alpha$ subfield periods sf having mutually identical lengths of time. In this case, $\alpha$ is an integer satisfying $1 \leq \alpha$. In the present embodiment, the frame period F includes the $2\alpha$ subfield periods sf.

Note that, in the present embodiment, a case in which $\alpha$ is "2" is exemplified and described as illustrated in FIG. 4 for the convenience of explanation. In other words, in the present embodiment, a case in which the frame period F is divided into four subfield periods sf1 to sf4 is exemplified and described. More specifically, in the present embodiment, the first unit period U1 includes the first subfield period sf1 and the second subfield period sf2, and the second unit period U2 includes the third subfield period sf3 and the fourth subfield period sf4. Note that, in the present embodiment, $\alpha=2$ is assumed, but $\alpha$ may be any number as long as $\alpha$ is an integer satisfying $1 \leq \alpha$. In addition, the present embodiment describes the example in which the subfield periods sf have the identical length of time, but the subfield periods may have different lengths of time.

The data line drive circuit 24 supplies, in each of the four subfield periods sf included in the frame period F of the unit pixel Px, the data signal VD[n] to the unit pixel Px. In the present embodiment, the data signal VD[n] is a signal specifying a gray scale level of the unit pixel Px in the one subfield period sf. In other words, by supplying the data signal VD[n] to each of the unit pixels Px for each of the subfield periods sf, the data line drive circuit 24 specifies a gray scale level of each of the unit pixels Px for each of the subfield periods sf.

The gray scale level that the unit pixel Px displays for a certain predetermined period of time is determined by an integrated value of relative transmittance of the liquid crystal element CL included in the unit pixel Px over the predetermined period of time. Specifically, the gray scale level that the unit pixel Px displays in the frame period F is determined based on an average of the gray scale levels of the four subfield periods sf1 to sf4 included in the frame period F.

Figure 5:
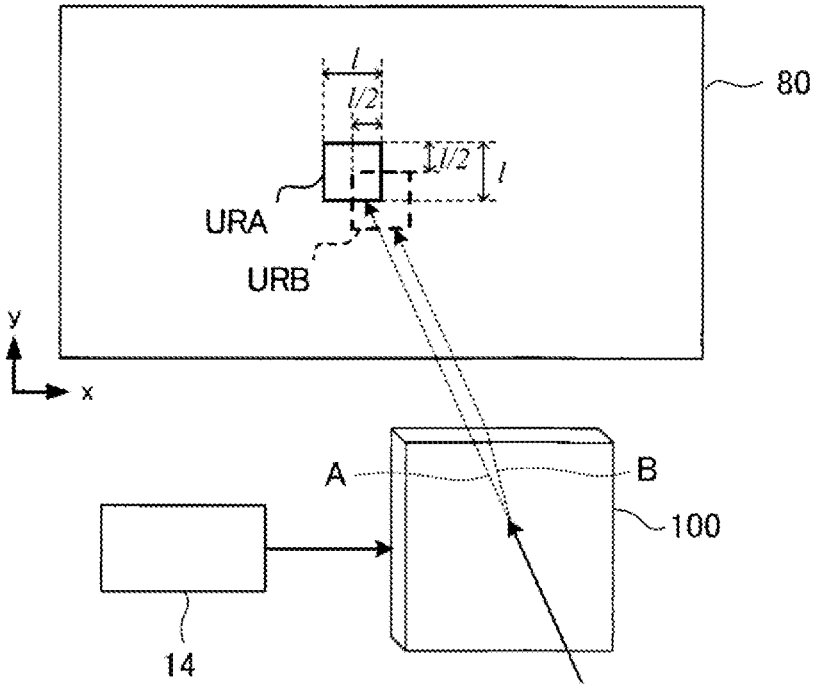
FIG. 5 is an explanatory diagram of operation of a light path shifting element.

Next, operation of the light path shifting element 100 will be described with reference to FIG. 5. FIG. 5 is an explanatory diagram of the operation of the light path shifting element 100. As described above, the light path shifting element 100 shifts a light path of incident light in one of two predetermined directions, and emits light. More specifically, the light path shifting element 100 changes a light path of light such that a first unit region URA at which light emitted from the illumination device 90 through each of the plurality of unit pixels Px arrives in the first unit period U1 differs from a second unit region URB at which the light arrives in the second unit period U2. As a result, on the screen 80, the region on which the light is projected via each of the unit pixels Px is different between the first unit period U1 and the second unit period U2. The first unit region URA is an example of a first region and the second unit region URB is an example of a second region. Also, the first unit region URA and the second unit region URB may be collectively referred to as unit regions UR. Further, a state of the light path shifting element 100 that irradiates the first unit region URA with light is referred to as a first state A, and a state of the light path shifting element 100 that irradiates the second unit region URB with light is referred to as a second state B.

FIG. 5 illustrates an example of the first unit region URA and the second unit region URB on the screen 80. In the example of FIG. 5, the second unit region URB is a region obtained by moving the first unit region URA on the screen 80 in a +x direction and a −y direction by a distance of half the unit pixels Px. As can be seen from FIG. 5, a portion of the first unit region URA and a portion of the second unit region URB overlap each other. Note that, in the present embodiment, an example in which the first unit region URA is a square is illustrated, but other shapes such as a rectangular shape may be used. Also, in the present embodiment, an example is illustrated in which the distance for moving the first unit region URA is the distance of half the unit pixels Px, but the distance may be any distance as long as the distance is less than a distance of the one unit pixel Px.

By performing pixel shifting processing that shifts a region on which light is projected, the number of apparent pixels increases and exceeds the number of unit pixels Px actually included in the liquid crystal panel 10. Thus, the projector 1 can make the resolution of an image projected on the screen 80 higher than the resolution of the liquid crystal panel 10 in a pseudo manner. Note that, the light path shifting element 100 may have a mechanical configuration or may have a liquid crystal type configuration. Controlling the light path shifting element 100 as described above realizes pixel shifting that is performed along one-axis in a 135 degree direction.

1.3. Details of Operation of Projector

Figure 6:
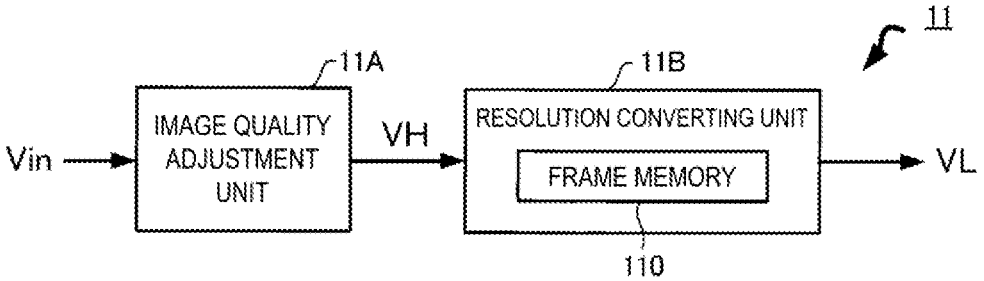
FIG. 6 is a block diagram illustrating a configuration example of an image processing unit.

FIG. 6 is a block diagram illustrating a configuration example of the image processing unit 11. As illustrated in FIG. 6, the image processing unit 11 includes an image quality adjustment unit 11A that generates an input image signal VH based on the input image signal Vin, and a resolution converting unit 11B that generates the output image signal VL by reducing resolution of the input image signal VH.

When the input image signal Vin is supplied from a higher-level device, the image quality adjustment unit 11A adjusts characteristics such as brightness of an image represented by the input image signal Vin in accordance with display characteristics of the liquid crystal panel 10, and generates the input image signal VH representing input image information. The input image signal Vin is a signal representing an image to be displayed by the plurality of unit pixels Px. More specifically, in the present embodiment, the input image signal Vin is digital data indicating a gray scale level of P bits to be displayed by each of the unit pixels Px in the frame period F. In this case, P is an integer satisfying $2 \leq P$. In the present embodiment, a case in which the input image signal Vin indicates a gray scale level of three bits is exemplified and described. More specifically, in the present embodiment, the input image signal Vin indicates a gray scale level to be displayed in eight stages from "0" to "7", that is, in three bits. Note that, the above number of bits is an example, and any other number may be used.

As with the input image signal Vin, the input image signal VH indicates a gray scale level of P bits. More specifically, the input image signal VH represents an image generated based on the input image signal Vin, and a pixel included in the image indicates the gray scale level of P bits.

Hereinafter, the image represented by the input image signal VH is referred to as a high-resolution image Mv. In addition, pixels included in the high-resolution image Mv are referred to as desired pixels Pv. In the present embodiment, resolution of the high-resolution image Mv exceeds the resolution of the liquid crystal panel 10. In this example, the high-resolution image Mv represented by the input image signal VH is assumed to have resolution that is four times the resolution of the liquid crystal panel 10. That is, the present embodiment assumes a case in which the one unit pixel Px corresponds to the four desired pixels Pv. More specifically, in the present embodiment, the liquid crystal panel 10 has the M×N unit pixels Px whereas the high-resolution image Mv has the 2M×2N desired pixels Pv. That is, the high-resolution image Mv represented by the input image signal VH corresponds to the 2M×2N desired pixels Pv, and an image represented by the output image signal VL corresponds to the M×N unit pixels Px. In the following description, a case of M=3 and N=4 is taken and described. However, the resolution of the high-resolution image Mv is not limited to the four times the resolution of the liquid crystal panel 10.

Figure 7:
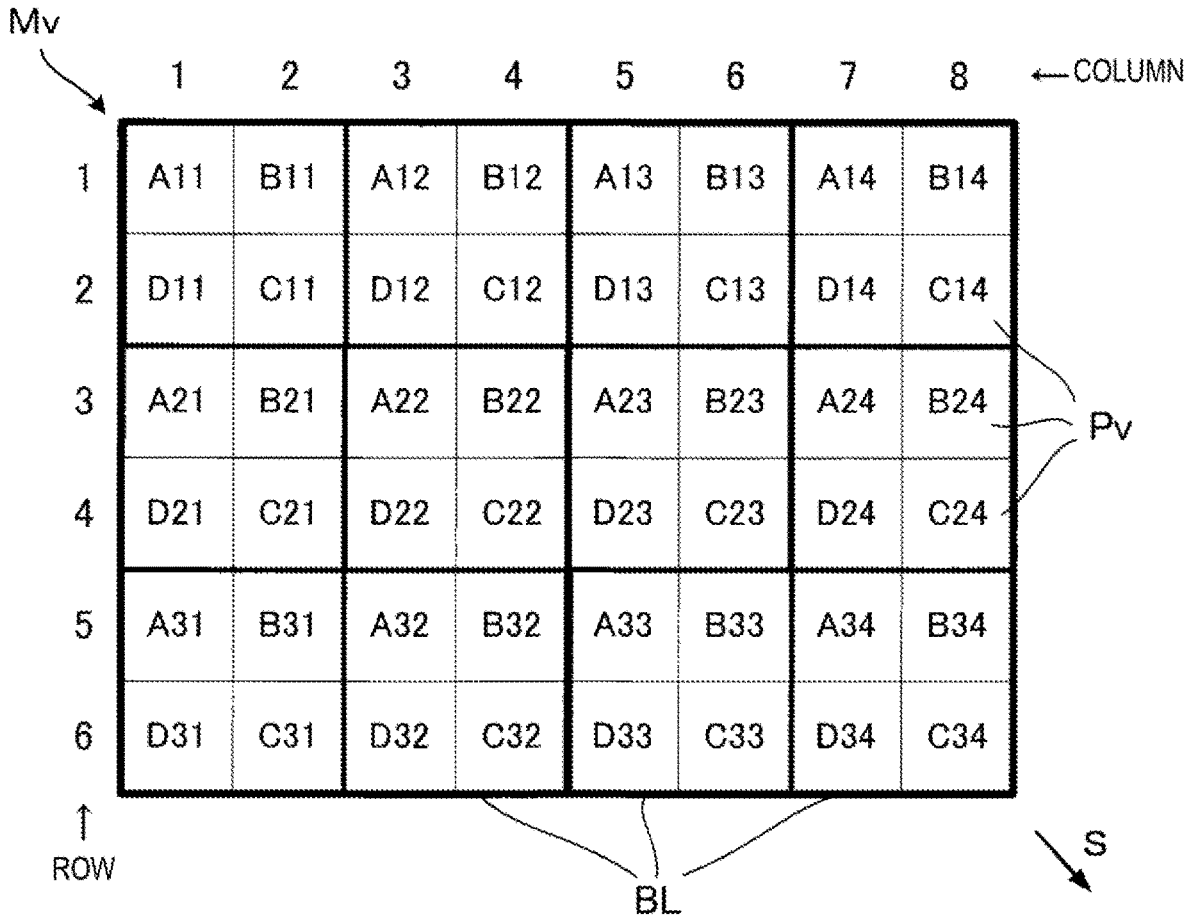
FIG. 7 is a diagram illustrating an example of a high-resolution image.
Figure 8:
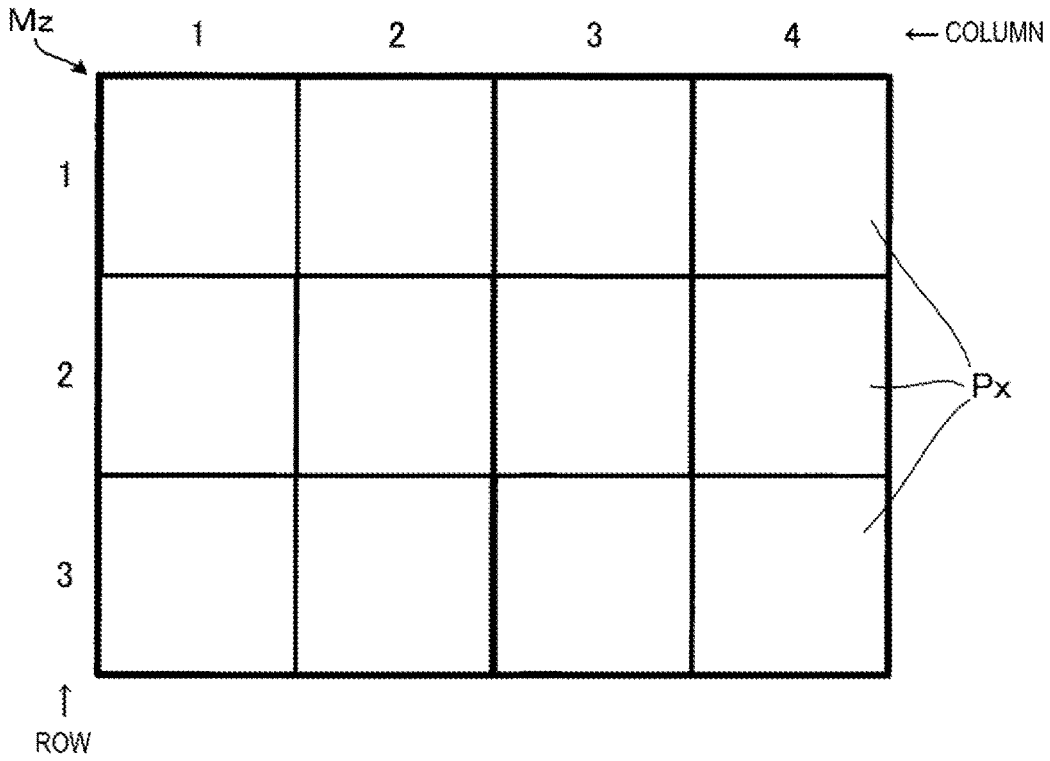
FIG. 8 is a diagram illustrating an example of a low-resolution image displayed on a liquid crystal panel.

FIG. 7 illustrates an example of the high-resolution image Mv, and FIG. 8 illustrates an example of a low-resolution image Mz displayed on the liquid crystal panel 10. The high-resolution image Mv illustrated in FIG. 7 consists of the desired pixels Pv of six rows by eight columns. The input image signal VH corresponding to one screen consists of pixel information indicating respective gray scale levels for the 48 pixels. In the following description, in the high-resolution image Mv, the four desired pixels Pv of two rows by two columns are referred to as a block BL. In the example illustrated in FIG. 7, the 12 blocks BL surrounded by bold lines are illustrated. In the pixel information illustrated in FIG. 7, in each of the blocks BL, pixel information corresponding to the desired pixel Pv disposed at an upper left is assigned a reference sign A, pixel information corresponding to the desired pixel Pv disposed at an upper right is assigned a reference sign B, pixel information corresponding to the desired pixel Pv disposed at lower right is assigned a reference sign C, and pixel information corresponding to the desired pixel Pv disposed at a lower left is assigned a reference sign D. Furthermore, a row number and a column number of the block BL arranged in three rows by four columns are used as reference numerals for pixel information.

For example, since the desired pixel Pv disposed in a third row from a top and a third column from a left is positioned at an upper left in the block BL of two rows by two columns, pixel information corresponding to the desired pixel Pv is denoted by "A22". In addition, as illustrated in FIG. 8, the low-resolution image Mz displayed on the liquid crystal panel 10 consists of the unit pixels Px of three rows by four columns. The unit pixel Px of the low-resolution image Mz corresponds to the block BL of the high-resolution image Mv illustrated in FIG. 7. In addition, originally, although respective pieces of information are present corresponding to the liquid crystal panels 10R, 10G, and 10B, one type will be described for the convenience of explanation. Each of the liquid crystal panels 10R, 10G, and 10B can be similarly applied.

Figure 9:
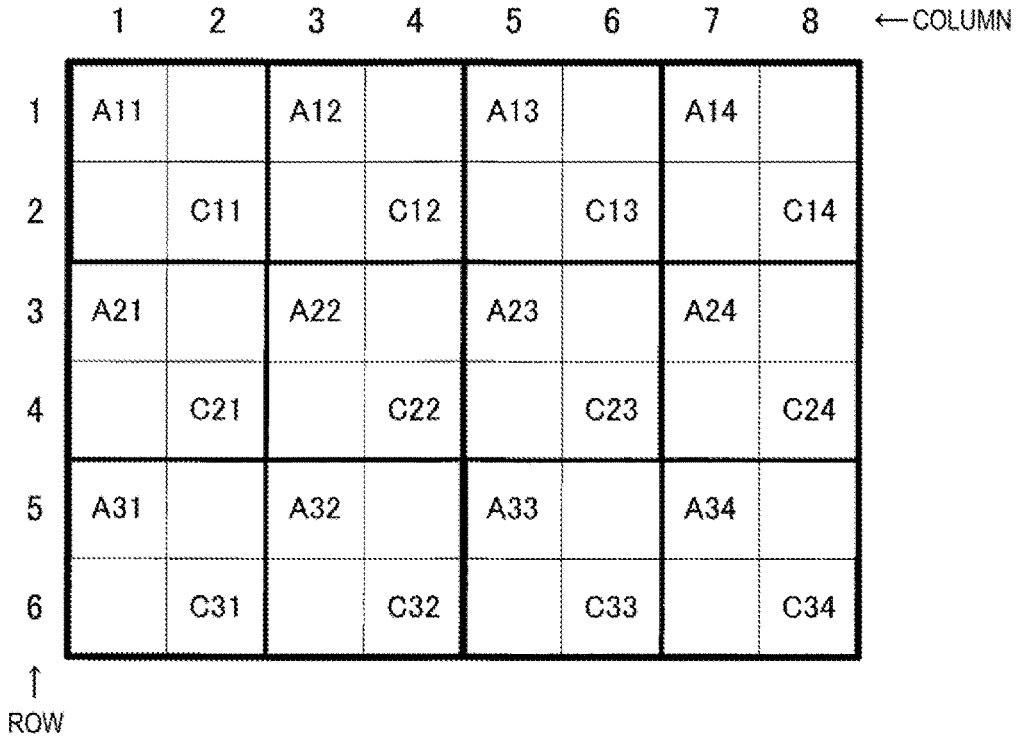
FIG. 9 is a diagram illustrating an example of an image schematically illustrating a result of a selection process.

The resolution converting unit 11B includes a frame memory 110. The resolution converting unit 11B executes a selection process for selecting only the pixel information of the desired pixel Pv at the upper left (assigned the reference numeral A) and the pixel information of the desired pixel Pv at the lower right (assigned the reference numeral C) of each of the blocks BL of the high-resolution image Mv illustrated in FIG. 7. FIG. 9 is an image schematically illustrating a result of the selection process. The resolution converting unit 11B leaves out the other pixel information assigned the reference numerals B and D, and stores display image signals including only a half number of pieces of pixel information of the pixel information constituting the input image signal VH in the frame memory 110.

Figure 10:
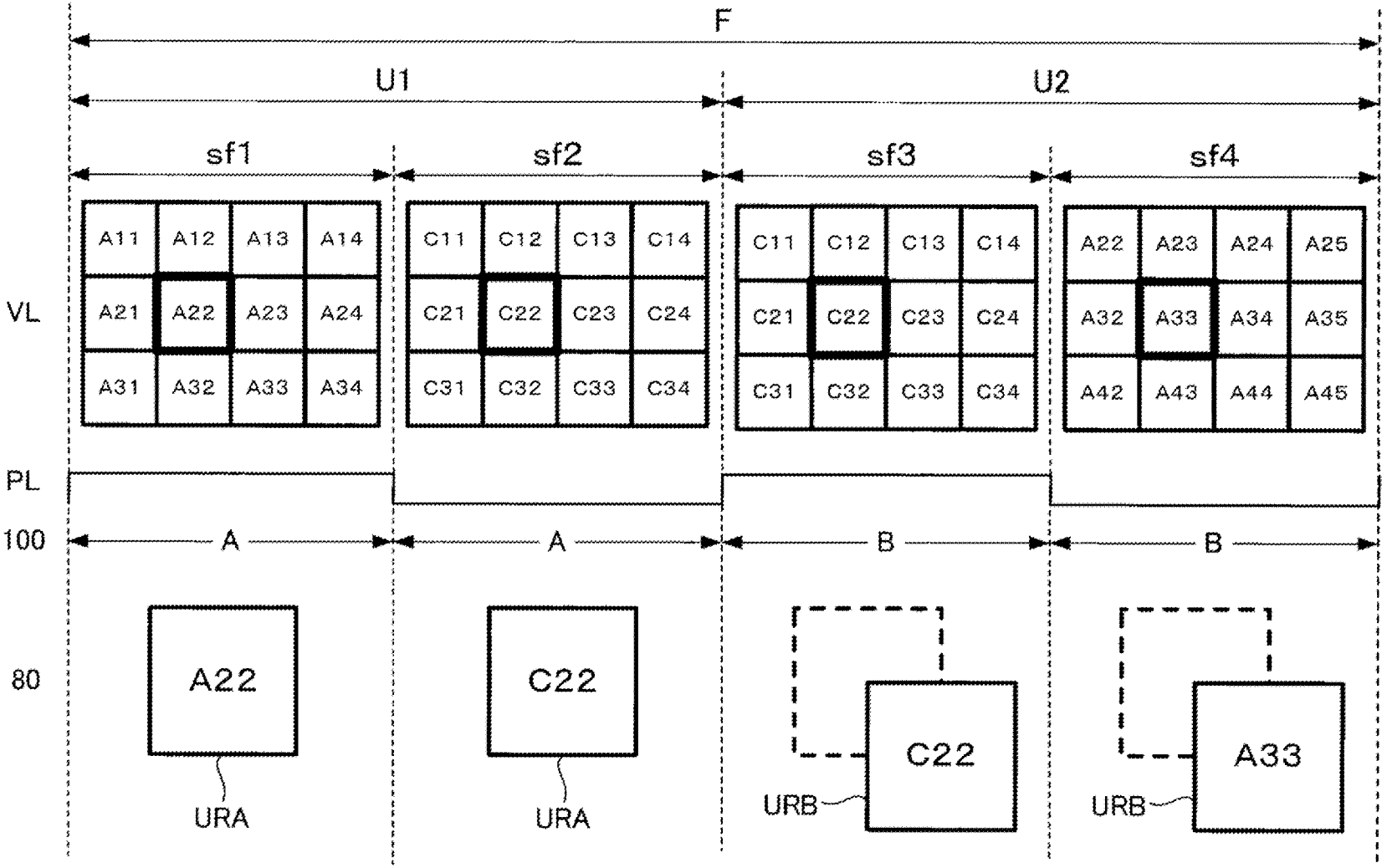
FIG. 10 is a diagram illustrating output image signals generated in each subfield period.

Next, the resolution converting unit 11B generates the output image signal VL by reading the display image signal from the frame memory 110 according to a predetermined rule. FIG. 10 illustrates the output image signal VL generated in each of the subfield periods sf1 to sf4.

First, in the first subfield period sf1 of the first unit period U1, the resolution converting unit 11B extracts the pixel information assigned the reference numeral A required for display in the first subfield period sf1 within the first unit period U1 from the display image signal stored in the frame memory 110, and generates the output image signal VL. That is, in the block BL of the high-resolution image Mv corresponding to the unit pixel Px of the low-resolution image Mz, pixel information of the desired pixel Pv disposed at an upper left is extracted. For example, by focusing on the unit pixels Px in a second row and a second column of the liquid crystal panel 10 of three rows by four columns, that is, an example of a predetermined pixel illustrated by a thick frame in FIG. 10, a gray scale level of the unit pixel Px is a gray scale level based on pixel information A22. In addition, since the light path shifting element 100 is in the first state A in the first unit period U1, the projector 1 irradiates the first unit region URA with light in the first subfield period sf1.

Next, in the second subfield period sf2, the resolution converting unit 11B extracts the pixel information assigned the reference numeral C required for display in the second subfield period sf2 within the first unit period U1 from the display image signal stored in the frame memory 110, and generates the output image signal VL. That is, in the block BL of the high-resolution image Mv corresponding to the unit pixel Px of the low-resolution image Mz, pixel information of the desired pixel Pv disposed at a lower right is extracted. For example, by focusing on the unit pixels Px in the second row and the second column that is illustrated by the thick frame in FIG. 10, the gray scale level of the unit pixel Px is a gray scale level based on pixel information C22. In addition, since the light path shifting element 100 is in the first state A in the second subfield period sf2, the projector 1 irradiates the first unit region URA with light.

Next, in the third subfield period sf3, the resolution converting unit 11B extracts the pixel information assigned the reference numeral C required for display in the third subfield period sf3 within the second unit period U2 from the display image signal stored in the frame memory 110, and generates the output image signal VL. That is, in the block BL of the high-resolution image Mv corresponding to the unit pixel Px of the low-resolution image Mz, pixel information of the desired pixel Pv disposed at the lower right is extracted. For example, by focusing on the unit pixels Px in the second row and the second column that is illustrated by the thick frame in FIG. 10, the gray scale level of the unit pixel Px is a gray scale level based on the pixel information C22. In addition, since the light path shifting element 100 is in the second state B in the second unit period U2, the projector 1 irradiates the second unit region URB with light in the third subfield period sf3.

Next, in the fourth subfield period sf4, the resolution converting unit 11B extracts the pixel information assigned the reference numeral C required for display in the fourth subfield period sf4 within the second unit period U2 from the display image signal stored in the frame memory 110, and generates the output image signal VL. However, the pixel information required for display in the fourth subfield period sf4 is pixel information of the desired pixel Pv disposed at an upper left of the block BL positioned in a pixel shifting direction with respect to the block BL of the high-resolution image Mv corresponding to the unit pixel Px of the low-resolution image Mz. In this example, the pixel shifting is performed in a direction S illustrated in FIG. 7. For example, by focusing on the unit pixels Px in the second row and the second column illustrated by the thick frame in FIG. 10, a gray scale level of the unit pixel Px is a gray scale level based on pixel information A33. In addition, since the light path shifting element 100 is in the second state B in the fourth subfield period sf4, the projector 1 irradiates the second unit region URB with light.

Furthermore, as illustrated in FIG. 10, the polarity signal PL is inverted for each of the subfield periods sf. In this example, the polarity signal PL specifies a positive polarity at a high level and specifies a negative polarity at a low level. In particular, in the second subfield period sf2 and the third subfield period sf3, the output image signals VL that are identical are written to the respective unit pixels Px, but polarity is inverted between the second subfield period sf2 and the third subfield period sf3, so a balance of a voltage applied to the liquid crystal element CL can be favorably maintained.

Note that, in the present embodiment, only those assigned the reference sign A and the reference sign C are selected as the pixel information constituting the output image signal VL, however, when identical pixel information exists in part of the pixel information displayed in the first unit period U1 and part of the pixel information displayed in the second unit period U2, a method for selection thereof is arbitrary.

With the operation described above, the display below is made by the pixel shifting on the display surface of the screen 80, by light emitted from the unit pixels Px in the second row and the second column of the liquid crystal panel 10 that is an example of the predetermined pixel. First, in the first subfield period sf1 that is one subfield period within the first unit period U1, an image corresponding to the pixel information A22 that is an example of a first pixel information, is displayed in the first unit region URA. Next, in the second subfield period sf2 that is another subfield period within the first unit period U1, an image corresponding to the pixel information C22 that is an example of a second pixel information, is displayed in the first unit region URA. Next, the image corresponding to the pixel information C22 is displayed in the second unit region URB in the third subfield period sf3 that is one subfield period within the second unit period U2. Furthermore, an image corresponding to the pixel information A33 that is an example of a third pixel information is displayed in the second unit region URB, in the fourth subfield period sf4 that is another subfield period of the second unit period U2.

As a result, the pixel information C22 is displayed twice in the second subfield period sf2 and the third subfield period sf3, and thus in a region where the first unit region URA and the second unit region URB overlap, an image represented by the pixel information C22 is relatively emphasized and displayed as compared to images represented by the other pixel information.

1.4. Reproducibility in Dot Display

Figure 11:
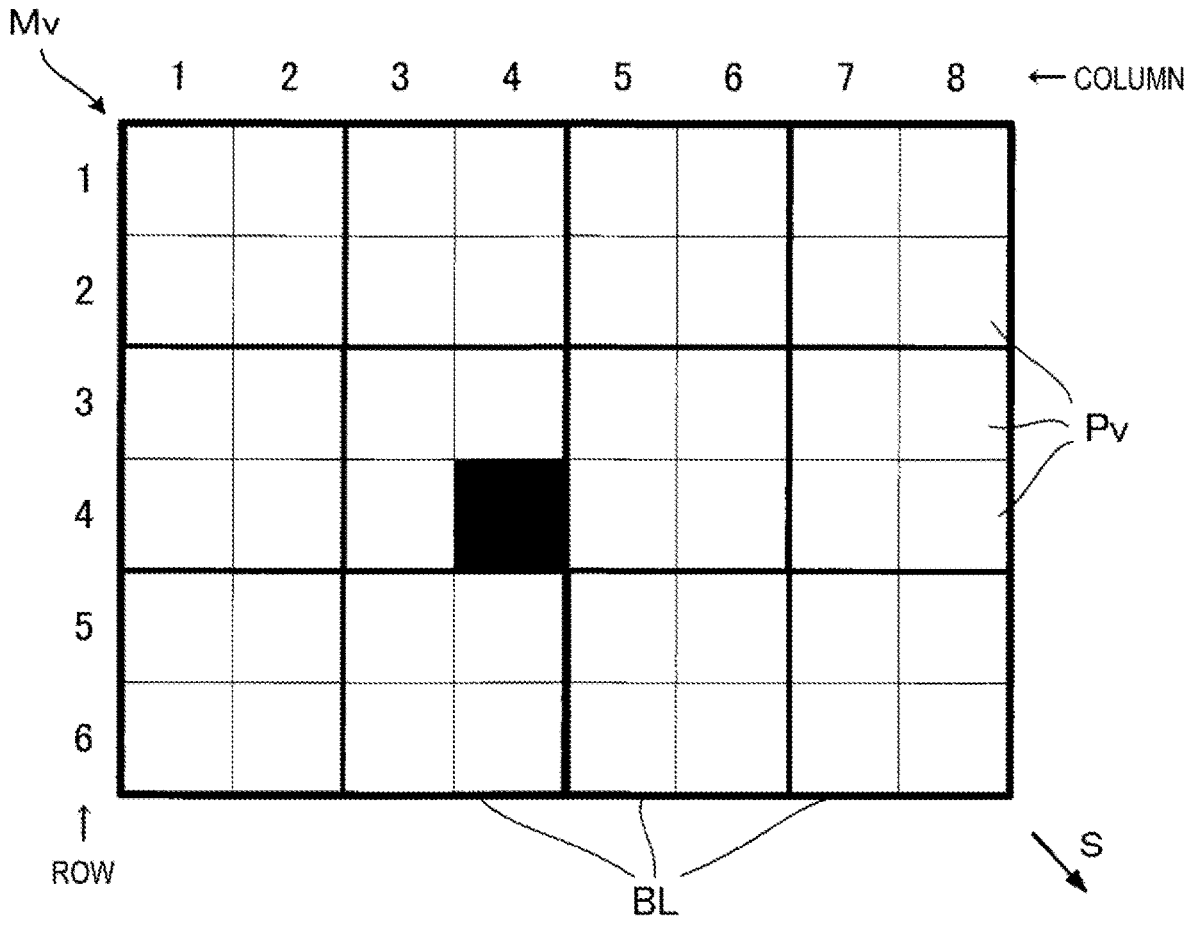
FIG. 11 is a diagram illustrating one-dot display of a high-resolution image.
Figure 12:
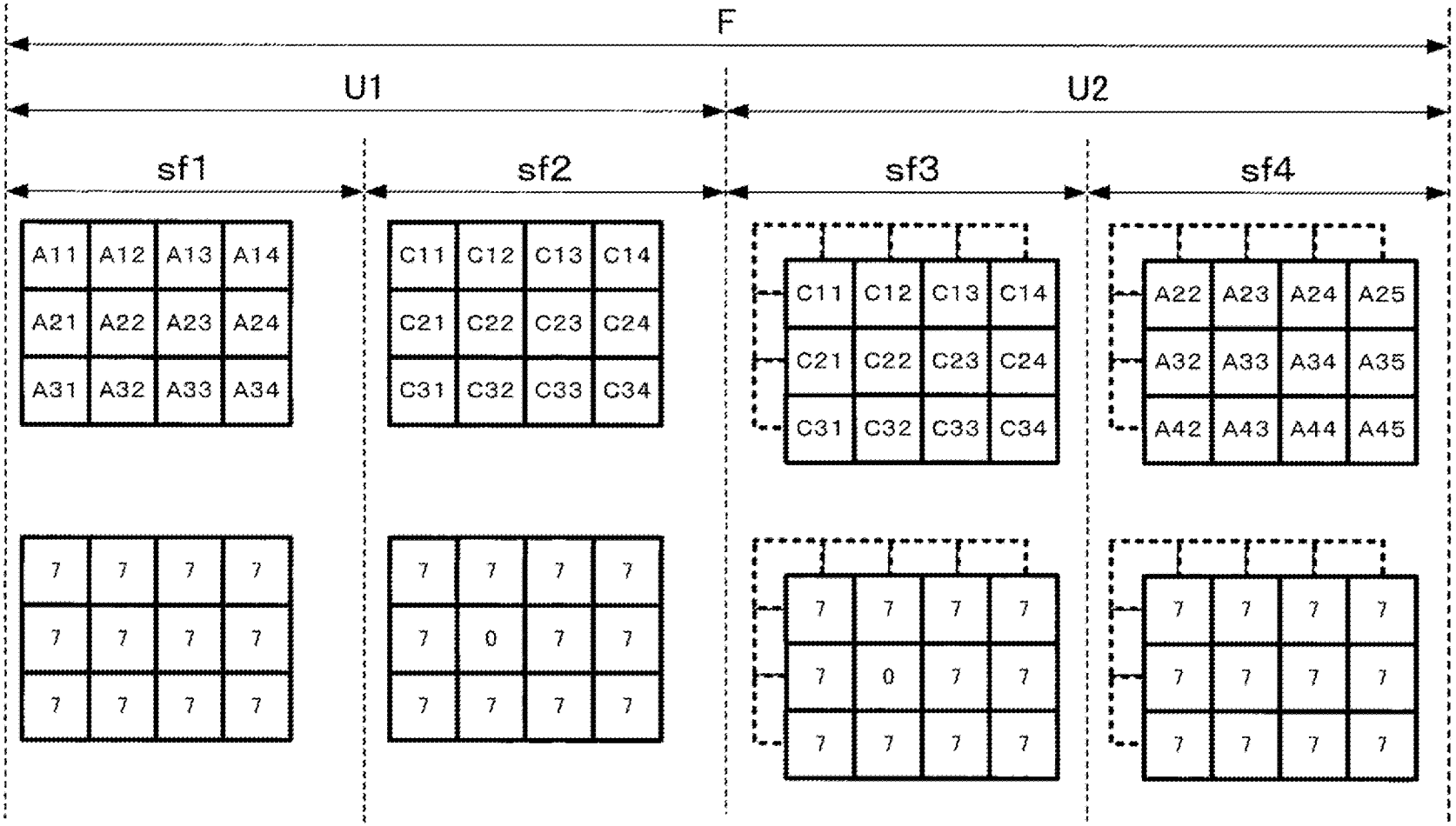
FIG. 12 is a diagram illustrating an example of an image displayed on a display surface of a screen.

Next, reproducibility in one-dot display will be described. FIG. 11 is a diagram illustrating one-dot display of the high-resolution image Mv. First, as the high-resolution image Mv, a case is assumed in which a gray scale level of the unit pixels Px in a fourth row and a fourth column is "0" corresponding to black, and a gray scale level of the other unit pixels Px is "7" corresponding to white as illustrated in FIG. 11. When the above-described pixel shifting is applied to the above high-resolution image Mv, images illustrated in FIG. 12 are displayed on the display surface of the screen 80. Since the images illustrated in FIG. 12 are integrated by human vision, black in one dot is relatively emphasized, as illustrated in FIG. 13.

On the other hand, in the pixel shifting in the related art, pixel information of the desired pixel Pv at an upper left of the block BL of the high-resolution image Mv is selected in the first unit period U1, and the light path shifting element 100 is set to the first state A. In addition, pixel information of the desired pixel Pv at lower right of the block BL of the high-resolution image Mv is selected in the second unit period U2, and the light path shifting element 100 is set to the second state B. Thus, as illustrated in FIG. 14 as a comparative example, black in one dot is displayed as gray.

Figure 13:
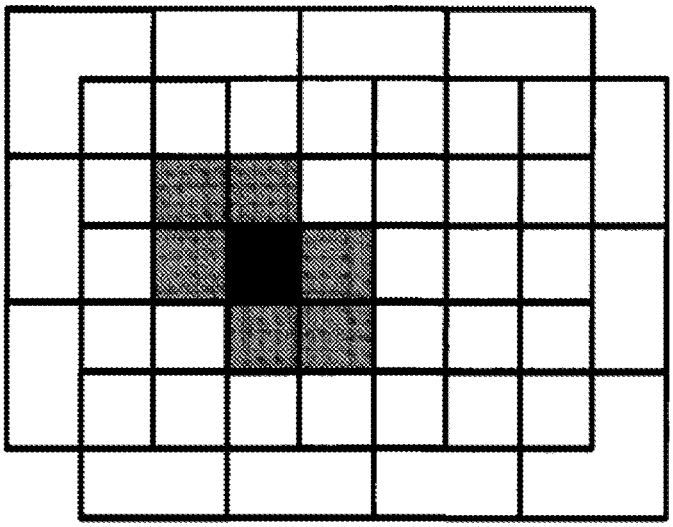
FIG. 13 is a diagram illustrating an example of one-dot display displayed on the display surface of the screen.
Figure 14:
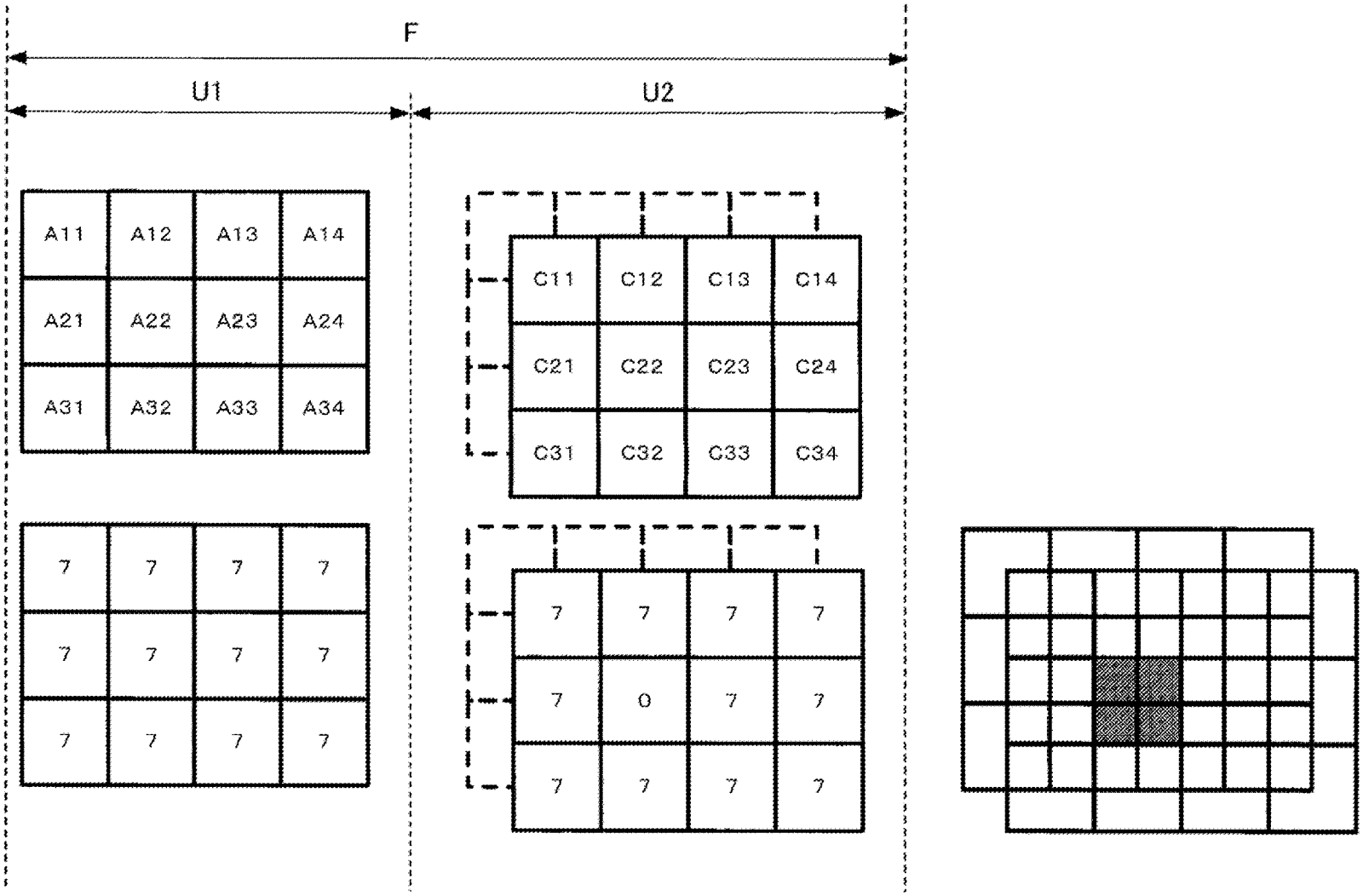
FIG. 14 is a diagram illustrating a comparative example of pixel shifting.

Comparing FIG. 13 with FIG. 14, according to the present embodiment, the one-dot display in black is emphasized at a position of the pixel information C22 that is an original position in the high-resolution image Mv. Thus, the reproducibility in the one-dot display is favorable.

Figure 15:
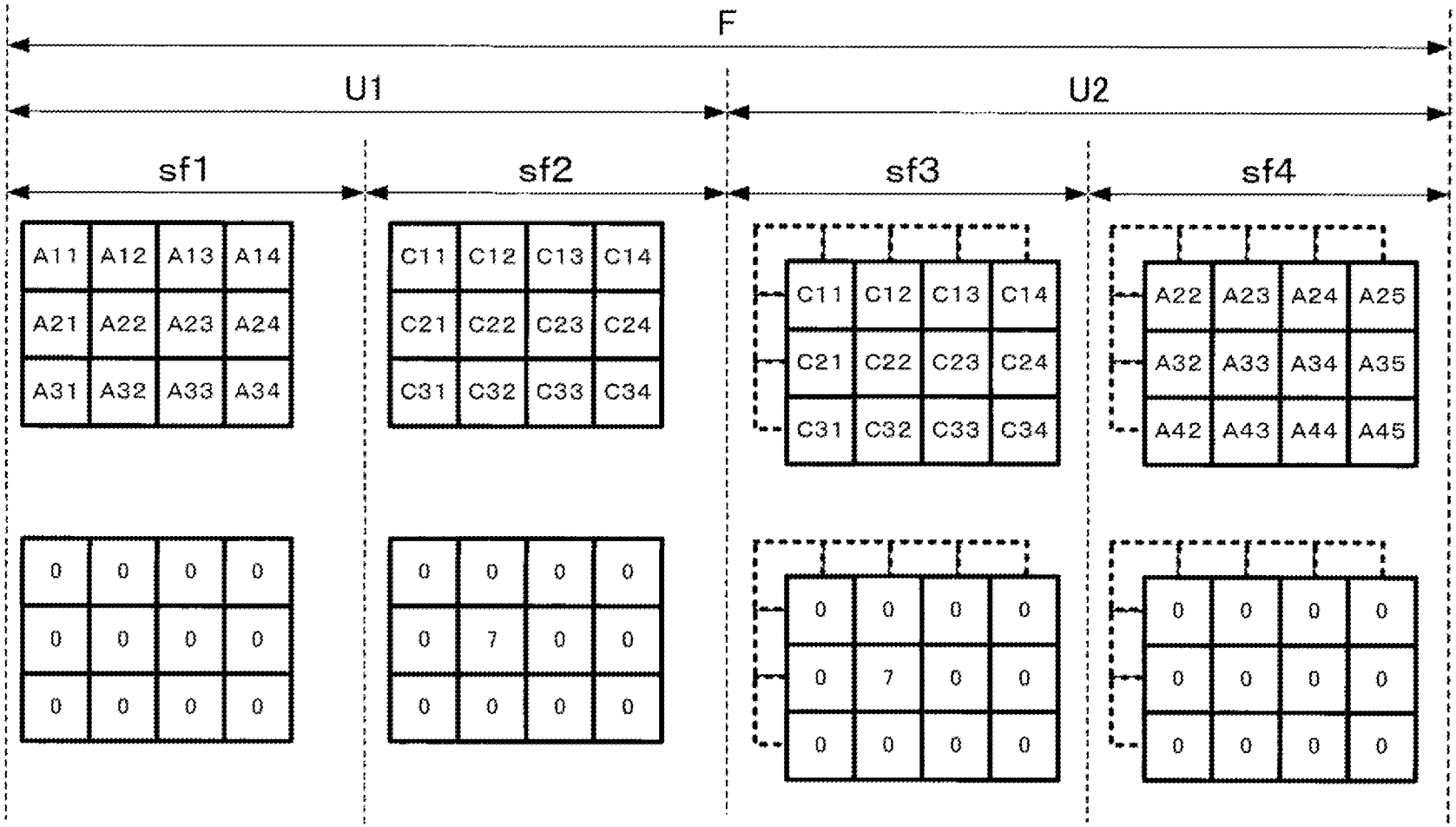
FIG. 15 is a diagram illustrating another example of the image displayed on the display surface of the screen.
Figure 16:
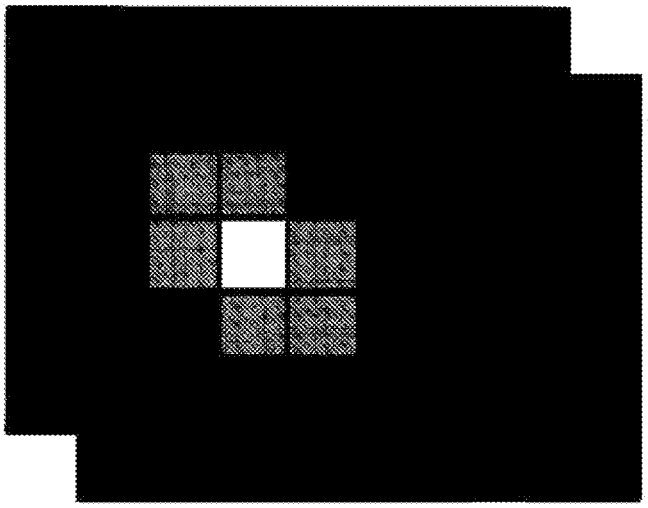
FIG. 16 is a diagram illustrating another example of the one-dot display displayed on the display surface of the screen.
Figure 17:
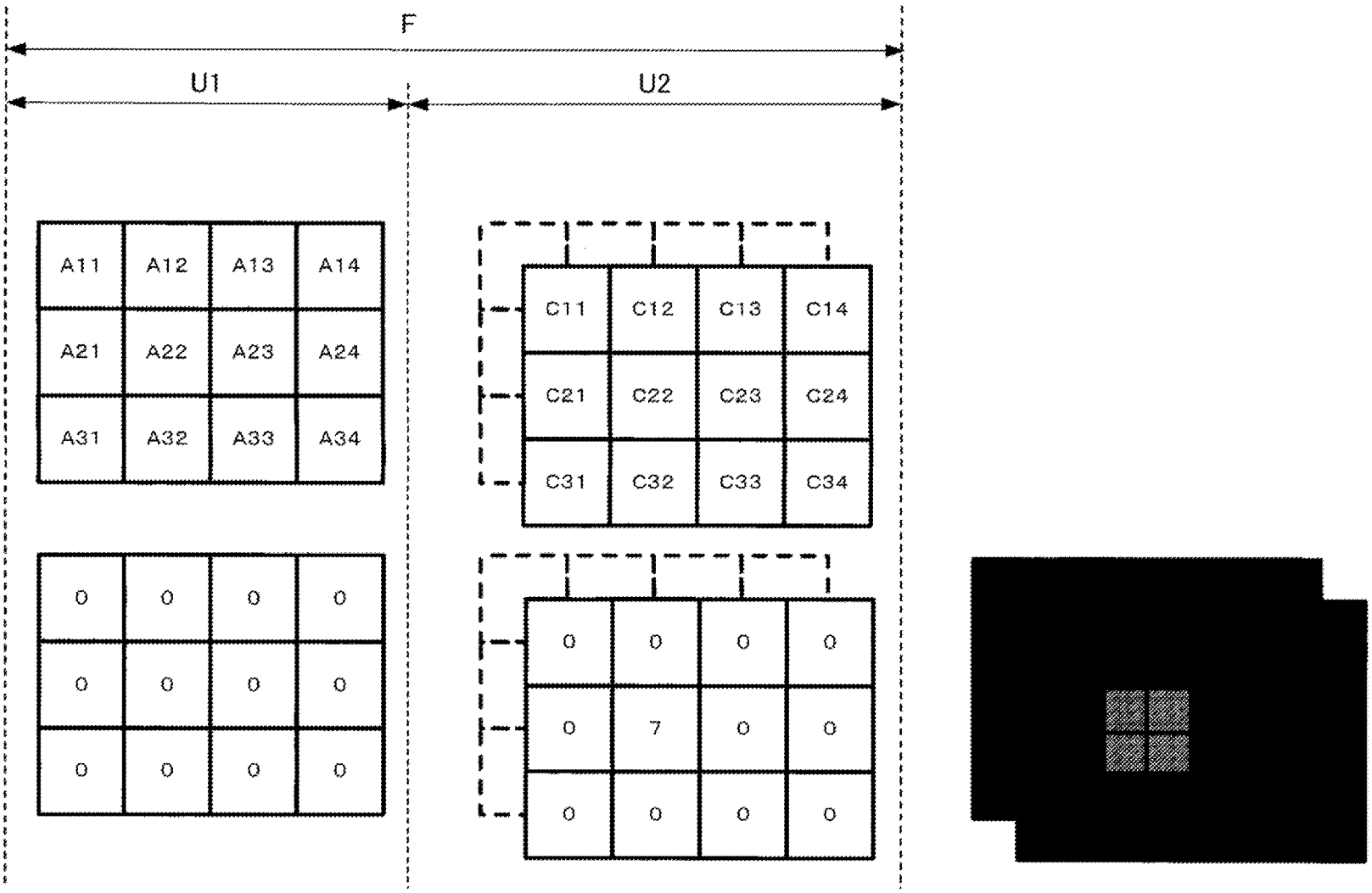
FIG. 17 is a diagram illustrating a comparative example of the pixel shifting.

Next, a case is assumed in which the gray scale level of the unit pixels Px in the fourth row and the fourth column is "7" corresponding to white, and the gray scale level of the other unit pixels Px is "0" corresponding to black. When the above-described pixel shifting is applied to the above high-resolution image Mv, images illustrated in FIG. 15 are displayed on the display surface of the screen 80. Since the images illustrated in FIG. 15 are integrated by human vision, white in one dot is relatively emphasized, as illustrated in FIG. 16. FIG. 17 illustrates display in the pixel shifting in the related art as a comparative example. Comparing FIG. 16 with FIG. 17, according to the present embodiment, the one-dot display in white is emphasized at a position of the pixel information C22 that is an original position in the high-resolution image Mv. Thus, the reproducibility in the one-dot display is favorable.

As described above, the projector 1 according to First Embodiment includes the liquid crystal panel 10 that is an example of an electro-optical panel in which a plurality of pixels including a predetermined pixel are arranged. Further, the projector 1 includes the light path shifting element 100 that changes a light path of light so that the first unit region URA that is the example of the first region in which light emitted through a predetermined pixel reaches a display surface in the first unit period U1 including the α subfield periods sf and the second unit region URB that is the example of the second region in which the light reaches the display surface in the second unit period U2 including the α subfield periods sf partially overlap. Furthermore, the projector 1 includes the control unit 50 that, based on the pixel information A22 indicating a gray scale level of a first pixel, the pixel information C22 indicating a gray-scale level of a second pixel, and the pixel information A33 indicating a gray scale level of a third pixel, displays the image corresponding to the pixel information A22 in the predetermined pixel in one subfield period sf within the first unit period U1, displays the image corresponding to the pixel information C22 on the predetermined pixel in another subfield period within the first unit period U1, displays the image corresponding to the pixel information C22 on the predetermined pixel in one subfield period sf within the second unit period U2, and displays the image corresponding to the pixel information A33 in the predetermined pixel in another subfield period sf within the second unit period U2.

Here, the desired pixel Pv in a first row and a first column of the block BL in the high-resolution image Mv is an example of the first pixel, and the desired pixel Pv in a second row and a second column of the block BL is an example of the second pixel. Furthermore, the desired pixel Pv in the first row and the first column of block BL positioned in the pixel shifting direction with respect to the block BL is an example of the third pixel.

According to this aspect, the image corresponding to the pixel information C22 is displayed in the predetermined pixel in the first unit period U1 and the second unit period U2, thus the reproducibility in the one-dot display can be increased.

Additionally, in First Embodiment, the control unit 50 inverts the polarity of the voltage to be applied to the liquid crystal element CL included in the predetermined pixel of the liquid crystal panel 10, for each of the subfield periods sf. Accordingly, in the third subfield period sf3 and the fourth subfield period sf4 in which an identical image is displayed, it is possible to favorably maintain the balance of the voltage applied to the liquid crystal element CL. As a result, ghosting of the liquid crystal panel 10 can be suppressed and reliability can be improved.

2. Second Embodiment

A configuration of the projector 1 according to Second Embodiment is identical to that of the projector 1 of the First Embodiment illustrated in FIGS. 1 and 2, and only the operation of the resolution converting unit 11B illustrated in FIG. 6 is different. Hereinafter, the difference will be described.

In First Embodiment, the example has been described in which, the pixel information A22 is displayed in the first subfield period sf1, the pixel information C22 is displayed in the second subfield period sf2, the pixel information C22 is displayed in the third subfield period sf3, and the pixel information A33 is displayed in the fourth subfield period sf4, however, the order of display is not limited thereto.

Since the output image signal VL is generated by the resolution converting unit 11B illustrated in FIG. 6 reading a display image signal from the frame memory 110, depending on the way of the generation, images based on the pixel information can be displayed in a different order.

Figure 18A:
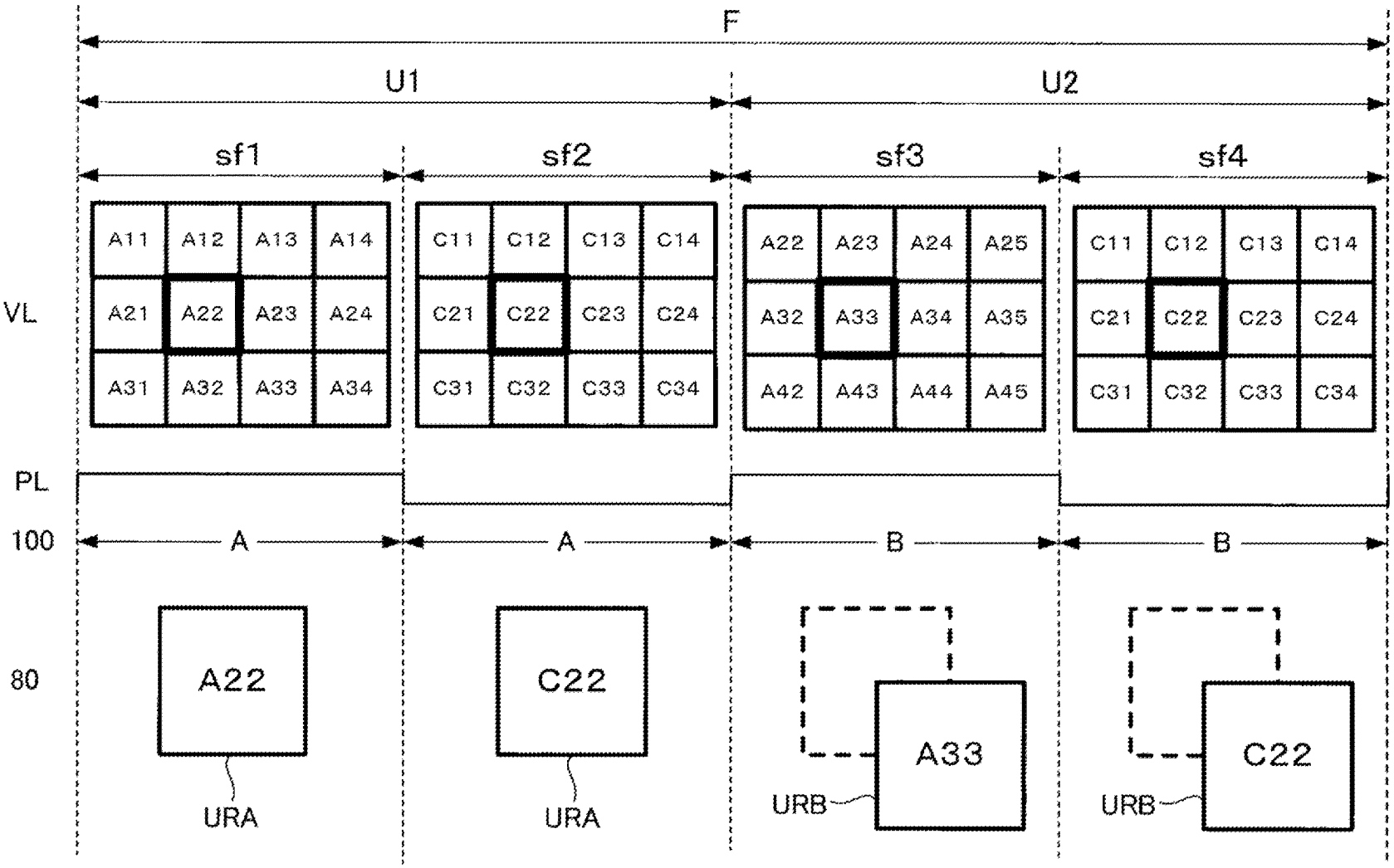
FIG. 18A is a diagram illustrating a first aspect of pixel shifting display according to Second Embodiment.

FIG. 18A illustrates a first aspect of pixel shifting display according to Second Embodiment. In this example, in the third subfield period sf3, display is identical to that of the fourth subfield period sf4 of First Embodiment illustrated in FIG. 10, and in the fourth subfield period sf4, display is identical to that of the third subfield period sf3 of First Embodiment. As a result, in the unit pixels Px in a second row and a second column of the liquid crystal panel 10, an image based on the pixel information A22, an image based on the pixel information C22, an image based on the pixel information A33, and the image based on the pixel information C22 are displayed in this order, in the subfield periods sf1 to sf4.

Figure 18B:
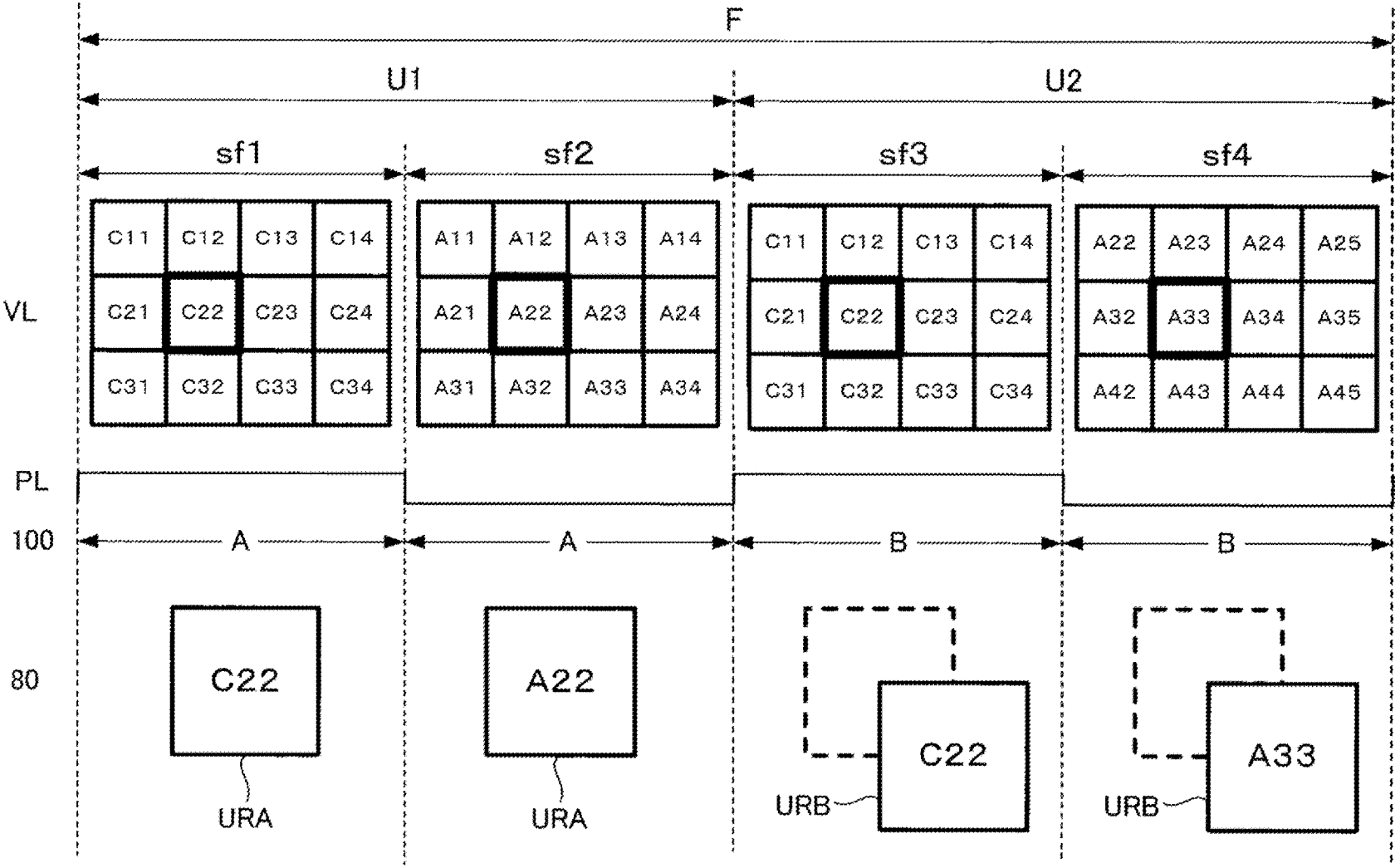
FIG. 18B is a diagram illustrating a second aspect of the pixel shifting display according to Second Embodiment.

FIG. 18B illustrates a second aspect of the pixel shifting display according to Second Embodiment. In this example, in the first subfield period sf1, display is identical to that of the second subfield period sf2 of First Embodiment illustrated in FIG. 10, and in the second subfield period sf2, display is identical to that of the first subfield period sf1 of First Embodiment. As a result, in the unit pixels Px in the second row and the second column of the liquid crystal panel 10, the image based on the pixel information C22, the image based on the pixel information A22, the image based on the pixel information C22, and the image based on the pixel information A33 are displayed in this order, in the subfield periods sf1 to sf4.

Figure 18C:
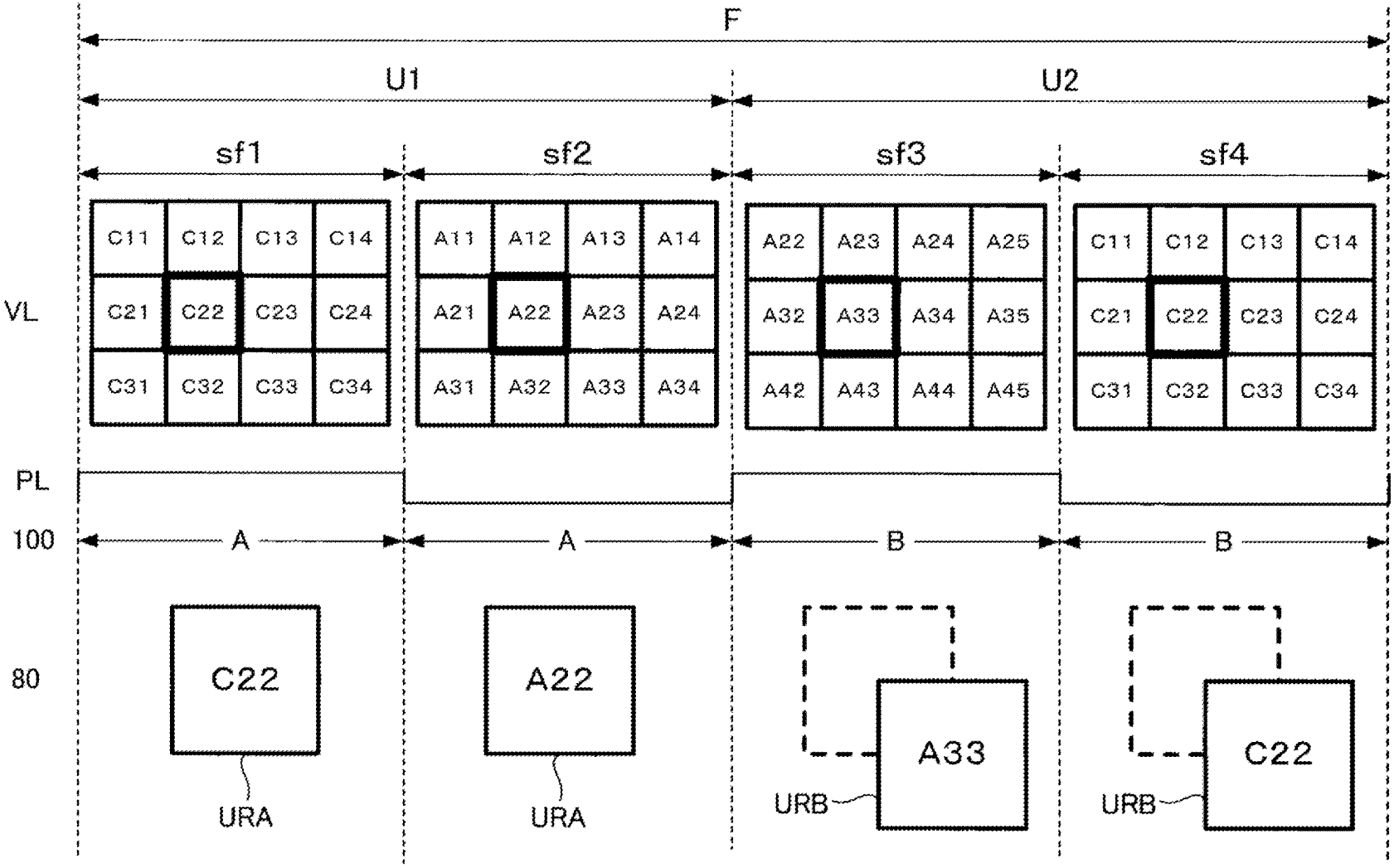
FIG. 18C is a diagram illustrating a third aspect of the pixel shifting display according to Second Embodiment.

FIG. 18C illustrates a third aspect of the pixel shifting display according to Second Embodiment. In this example, in the first subfield period sf1, display is identical to that of the second subfield period sf2 of First Embodiment illustrated in FIG. 10, and in the second subfield period sf2, display is identical to that of the first subfield period sf1 of First Embodiment. Further, in the third subfield period sf3, display is identical to that of the fourth subfield period sf4 of First Embodiment, and in the fourth subfield period sf4, display is identical to that of the third subfield period sf3 of First Embodiment. As a result, in the unit pixels Px in the second row and the second column of the liquid crystal panel 10, the image based on the pixel information C22, the image based on the pixel information A22, the image based on the pixel information A33, and the image based on the pixel information C22 are displayed in this order, in the subfield periods sf1 to sf4.

In the projector 1 of Second Embodiment, the resolution converting unit 11B of the control unit 50, in the second subfield period sf2 that is a last subfield period sf of the first unit period U1, for example, makes an image to be displayed in a predetermined pixel positioned in a second row and a second column of the liquid crystal panel 10 different from an image to be displayed on the predetermined pixel in the third subfield period sf3 that is a first subfield period sf of the second unit period U2.

Even in this case, in the first unit period U1 and the second unit period U2, the image based on the pixel information C22 is superimposed and displayed on a display surface of the screen 80, so reproducibility for one-dot display is favorable.

3. Third Embodiment

A configuration of the projector 1 according to Third Embodiment is identical to that of the projector 1 of First Embodiment illustrated in FIGS. 1 and 2, and only operation of the resolution converting unit 11B illustrated in FIG. 6 is different. Hereinafter, the difference will be described.

Figure 19:
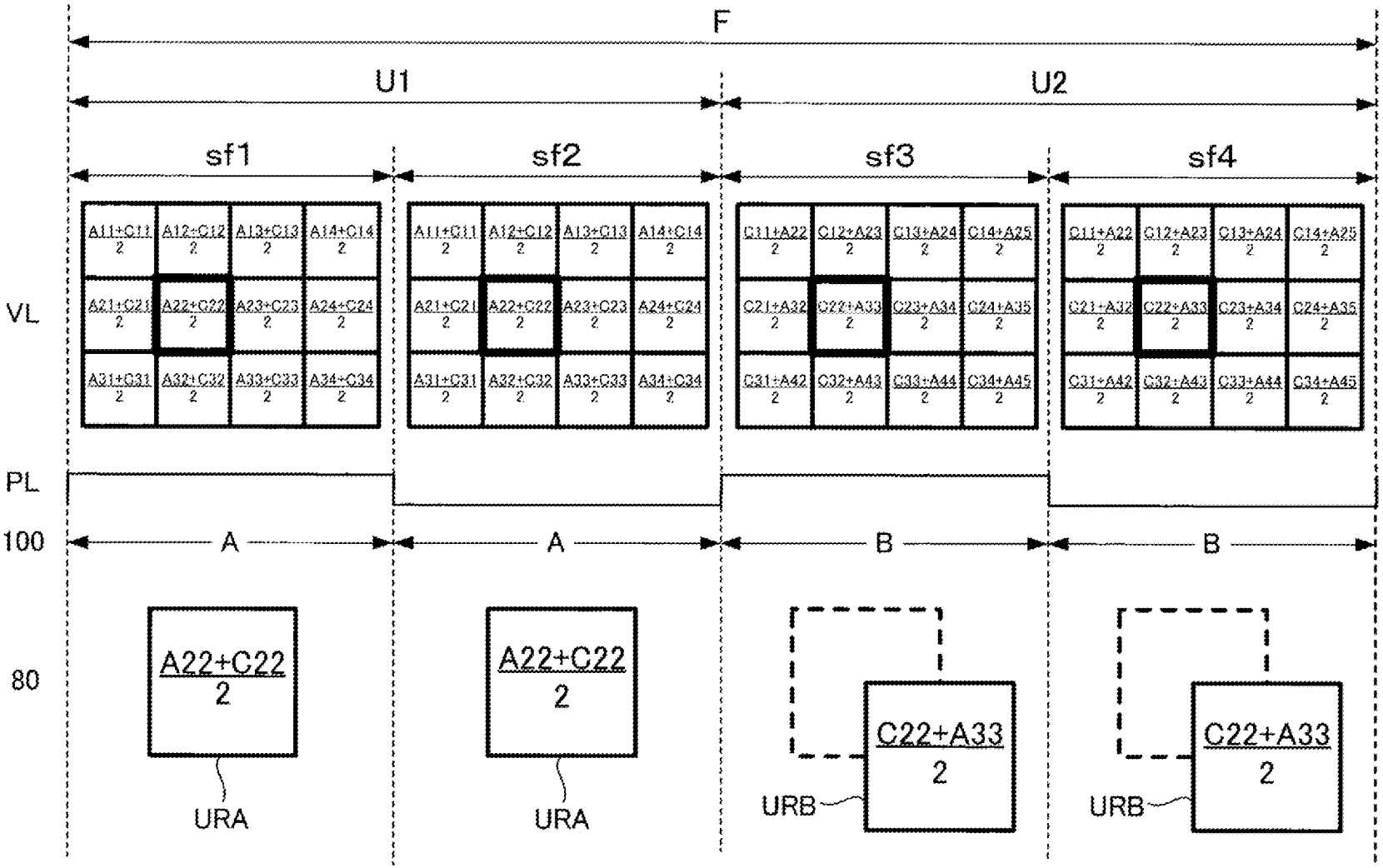
FIG. 19 is a diagram illustrating an aspect of pixel shifting display according to Third Embodiment.

FIG. 19 is an explanatory diagram of pixel shifting display according to Third Embodiment. The frame period F includes the first unit period U1 and the second unit period U2, and the two subfield periods sf are included in each of the unit periods U, as in the case of First Embodiment.

The resolution converting unit 11B of Third Embodiment generates an average value of the output image signal VL in the first subfield period sf1 and the output image signal VL in the second subfield period sf2 in First Embodiment illustrated in FIG. 10, in each of the first subfield period sf1 and the second subfield period sf2. Further, the resolution converting unit 11B generates an average value of the output image signal VL in the third subfield period sf3 and the output image signal VL in the fourth subfield period sf4 in First Embodiment illustrated in FIG. 10, in each of the third subfield period sf3 and the fourth subfield period sf4.

In FIG. 19, a gray scale level of the unit pixels Px in a second row and a second column of the liquid crystal panel 10 is "(A22+C22)/2" in the first unit period U1. This indicates an average value of a gray scale level of the pixel information A22 and a gray scale level of the pixel information C22. A gray scale level of the unit pixels Px in the second row and the second column of the liquid crystal panel 10 is "(C22+A33)/2" in the second unit period U2. This indicates an average value of the gray scale level of the pixel information C22 and a gray scale level of the pixel information A33.

The projector 1 of Third Embodiment includes the liquid crystal panel 10 that is an example of an electro-optical panel in which a plurality of pixels including a predetermined pixel are arranged. The projector 1 includes the light path shifting element 100 that changes a light path of light so that the first unit region URA that is an example of a first region in which light emitted through a predetermined pixel reaches a display surface in the first unit period U1 including $\alpha$ number of the subfield periods sf and the second unit region URB that is an example of a second region in which the light reaches the display surface in the second unit period U2 including $\alpha$ number of the subfield periods sf partially overlap. Further, the projector 1, includes the control unit 50 that, based on the pixel information A22 indicating a gray scale level of a first pixel, the pixel information C22 indicating a gray-scale level of a second pixel, and the pixel information A33 indicating a gray scale level of a third pixel, displays, in one subfield period sf within the first unit period U1 and another subfield period sf within the first unit period U1, an image corresponding to an average value of a gray scale level of the pixel information A22 and a gray scale level of the pixel information C22 in a predetermined pixel, and displays, in one subfield period sf within the second unit period U2 and another subfield period sf within the second unit period U2, an image corresponding to an average value of the gray scale level of the pixel information C22 and a gray scale level of the pixel information A33.

According to this aspect, in the subfield periods sf1 to sf4, half the gray scale level of the pixel information C22 is displayed each time, so reproducibility for one-dot display is favorable. In addition, with respect to AC driving of the liquid crystal panel 10, polarity is inverted in each of the subfield periods sf. Since the balance of a voltage applied to the liquid crystal element CL is favorable, a life of the liquid crystal element CL can be extended.

4. Modification Examples

Various types of modifications are possible in the embodiments described above. The above-described embodiments and the following modification examples may be combined as appropriate.

(1) In each of the above-described embodiments, the projector 1 using the liquid crystal panel 10 as the example of the electro-optical panel has been described, but a digital micromirror device may be used instead of the liquid crystal panel 10. In a projector using a digital micromirror device as an electro-optical panel, an image is projected onto the screen 80 by controlling the inclination of a mirror of the digital micromirror device covered with mirrors having high reflectance, and by controlling a light source. The digital micromirror device creates a portion that is irradiated with light and a portion that is not irradiated with light on a display surface of the screen 80 by controlling, with each mirror being a pixel, such that inclination of each mirror is switched between two states, namely an ON-state and an OFF-state. Brightness of light emitted from each mirror that is a pixel, is controlled by pulse-width modulation to the inclination of each mirror per the frame period F.

Figure 20A:
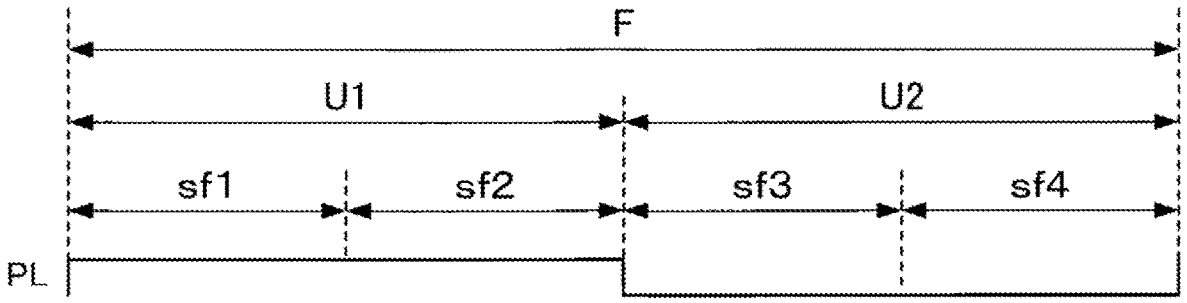
FIG. 20A is a diagram illustrating polarity inversion for each unit period of AC driving.
Figure 20B:
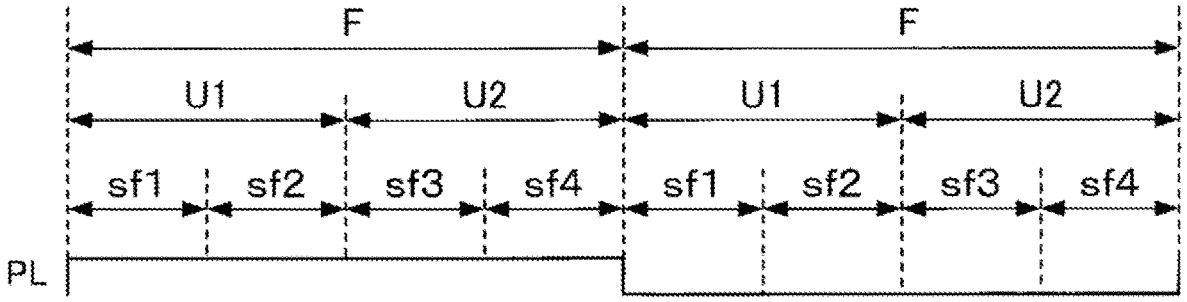
FIG. 20B is a diagram illustrating polarity inversion for each frame period of the AC driving.

(2) In each of the embodiments described above, the polarity inversion of the AC driving may invert the polarity of the voltage applied to the liquid crystal element CL included in the predetermined pixel for each of the unit periods U as illustrated in FIG. 20A. In the output image signal VL illustrated in any of FIG. 10 or FIGS. 18A to 18C, it is possible to favorably maintain the balance in the voltage applied to the liquid crystal element CL. Additionally, as illustrated in FIG. 20B, the polarity inversion of the AC driving may invert the polarity of the voltage applied to the liquid crystal element CL included in the predetermined pixel in each frame period F. Also in this case, in the output image signals VL illustrated in any of FIG. 10 and FIGS. 18A to 18C, it is possible to favorably maintain the balance in the voltage applied to the liquid crystal element CL.

Figure 20C:
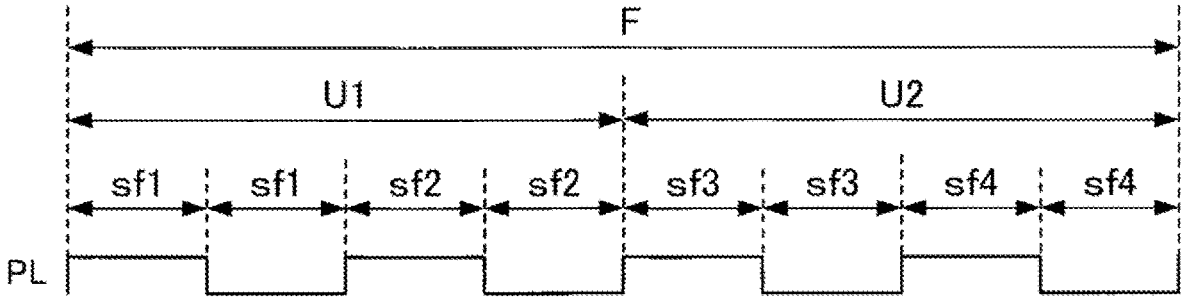
FIG. 20C is a diagram illustrating polarity inversion for each subfield of the AC driving.

In each of the above-described embodiments, the images based on the output image signal VL are also displayed on the liquid crystal panel 10 in each of the first subfield period sf1, the second subfield period sf2, the third subfield period sf3, and the fourth subfield period sf4. In this case, the image in the first subfield period sf1 is different from that in the second subfield period sf2, and the image in the third subfield period sf3 is different from that in the fourth subfield period sf4. Thus, even when the polarity inversion of the AC driving is performed for each of the subfield periods sf as in First Embodiment, the voltage applied to the liquid crystal element CL is not completely balanced in some cases. Thus, as illustrated in FIG. 20C, the control unit 50 iterates the first subfield period sf1 twice in the first unit period U1 to display an identical image on the liquid crystal panel 10, and then iterates the second subfield period sf2 twice to display an identical image on the liquid crystal panel 10. Further, the control unit 50 may iterate the third subfield period sf3 twice in the second unit period U2 to display an identical image on the liquid crystal panel 10, and then iterate the fourth subfield period sf4 twice to display an identical image on the liquid crystal panel 10. In this case, by iterating the polarity inversion of the AC driving for each of the subfield periods sf, the voltage applied to the liquid crystal element CL can be completely balanced. In other words, as illustrated in FIG. 20C, an identical image may be displayed on a predetermined pixel in one subfield period sf and a next subfield period sf, and the polarity of the voltage applied to the liquid crystal element CL included in the predetermined pixel may be inverted for each of the subfield periods sf. Also in this case, in the output image signals VL illustrated in any of FIG. 10 and FIGS. 18A to 18C, it is possible to favorably maintain the balance in the voltage applied to the liquid crystal element CL.

What is claimed is:

1. An electro-optical device, comprising:

an electro-optical panel in which a plurality of pixels are arranged, the plurality of pixels including a predetermined pixel that displays an image based on: (i) a first pixel information indicating a first gray scale level of a first pixel, (ii) a second pixel information indicating a second gray scale level different than the first gray scale level of a second pixel, and (iii) a third pixel information indicating a third gray scale level of a third pixel;

a light path shifting element configured to change a light path of light emitted via the predetermined pixel so that: (a) a first region in a display surface in a first unit period including $\alpha$ subfield periods, and (b) a second region in the display surface in a second unit period including $\alpha$ subfield periods, partially overlap where a is an integer satisfying $2 \leq \alpha$; and a control unit configured to:

display, on the predetermined pixel, an image corresponding to the first pixel information so that the light reaches the first region in the display surface, in one subfield period within the first unit period, display, on the predetermined pixel, an image corresponding to the second pixel information so that the light reaches the first region in the display surface, in another subfield period within the first unit period, display, on the predetermined pixel, an image corresponding to the second pixel information so that the light reaches the second region in the display surface, in one subfield period within the second unit period, and display, on the predetermined pixel, an image corresponding to the third pixel information so that the light reaches the second region in the display surface, in another subfield period within the second unit period, wherein:

the second pixel information indicating the second gray scale is respectively different from the first pixel information indicating the first gray scale and the third pixel information indicating the third gray scale, and the image corresponding to the second pixel information is displayed twice in a region where the first region and the second region in the display surface partially overlap, in the another subfield period within the first unit period and the one subfield period within the second unit period.

2. The electro-optical device according to claim 1, wherein the control unit is configured to make an image that is to be displayed on the predetermined pixel in a last subfield period of the first unit period different from an image that is to be displayed on the predetermined pixel in an initial subfield period of the second unit period.

3. The electro-optical device according to claim 1, wherein the electro-optical panel is a liquid crystal panel and the control unit is configured to invert, for each of the subfield periods, a polarity of a voltage applied to a liquid crystal element included in the predetermined pixel of the liquid crystal panel.

4. The electro-optical device according to claim 3, wherein the control unit is configured to display an identical image on the predetermined pixel in one field period and a next subfield period.

5. The electro-optical device according to claim 1, wherein the electro-optical panel is a liquid crystal panel and the control unit is configured to invert, for each of the unit periods, a polarity of a voltage applied to a liquid crystal element included in the predetermined pixel of the liquid crystal panel.

6. An electro-optical device, comprising:

an electro-optical panel in which a plurality of pixels are arranged, the plurality of pixels including a predetermined pixel that displays an image based on: (i) a first pixel information indicating a first gray scale level of a first pixel, (ii) a second pixel information indicating a second gray scale level different than the first gray scale level of a second pixel, and (iii) a third pixel information indicating a third gray scale level of a third pixel;

a light path shifting element configured to change a light path of light emitted via the predetermined pixel so that: (a) a first region in which the light reaches a display surface in a first unit period including $\alpha$ subfield periods, and (b) a second region in which the light reaches the display surface in a second unit period including $\alpha$ subfield periods, partially overlap where a is an integer satisfying $2 \leq \alpha$; and a control unit configured to:

display, on the predetermined pixel, an image corresponding to an average value of a gray scale level of the first pixel information and a gray scale level of the second pixel information so that the light reaches the first region in the display surface, in one subfield period within the first unit period and in another subfield period within the first unit period and display, on the predetermined pixel, an image corresponding to an average value of a gray scale level of the second pixel information and a gray scale level of the third pixel information so that the light reaches the second region in the display surface, in one subfield period within the second unit period and in another sub-field period within the second unit period, wherein:

the second pixel information indicating the second gray scale is respectively different from the first pixel information indicating the first gray scale and the third pixel information indicating the third gray scale, and the image corresponding to the second pixel information is displayed twice in a region where the first region and the second region in the display surface partially overlap, in the another subfield period within the first unit period and the one subfield period within the second unit period.

7. A method for controlling an electro-optical device including:

an electro-optical panel in which a plurality of pixels are arranged, the plurality of pixels including a predetermined pixel that displays an image based on: (i) a first pixel information indicating a first gray scale level of a first pixel, (ii) a second pixel information indicating a second gray scale level different than the first gray scale level of a second pixel, and (iii) a third pixel information indicating a third gray scale level of a third pixel, and a light path shifting element configured to change a light path of light emitted via the predetermined pixel so that: (a) a first region in which the light reaches a display surface in a first unit period including $\alpha$ subfield periods, and (b) a second region in which the light reaches the display surface in a second unit period including $\alpha$ subfield periods, partially overlap where a is an integer satisfying $2 \leq \alpha$, the method comprising:

displaying, on the predetermined pixel, an image corresponding to the first pixel information so that light reaches the first region in the display surface, in one subfield period within the first unit period;

displaying, on the predetermined pixel, an image corresponding to the second pixel information so that light reaches the first region in the display surface, in another subfield period within the first unit period;

displaying, on the predetermined pixel, an image corresponding to the second pixel information so that light reaches the second region in the display surface, in one subfield period within the second unit period; and displaying, on the predetermined pixel, an image corresponding to the third pixel information so that light reaches the second region in the display surface, in another subfield period within the second unit period, wherein:

the second pixel information indicating the second gray scale is respectively different from the first pixel information indicating the first gray scale and the third pixel information indicating the third gray scale, and the image corresponding to the second pixel information is displayed twice in a region where the first region and the second region in the display surface partially overlap, in the another subfield period within the first unit period and the one subfield period within the second unit period.

8. A method for controlling an electro-optical device including:

an electro-optical panel in which a plurality of pixels are arranged, the plurality of pixels including a predetermined pixel that displays an image based on: (i) a first pixel information indicating a first gray scale level of a first pixel, (ii) a second pixel information indicating a second gray scale level different than the first gray scale level of a second pixel, and (iii) a third pixel information indicating a third gray scale level of a third pixel, and a light path shifting element configured to change a light path of light emitted via the predetermined pixel so that: (a) a first region in which the light reaches a display surface in a first unit period including $\alpha$ subfield periods, and (b) a second region in which the light reaches the display surface in a second unit period including $\alpha$ subfield periods, partially overlap where a is an integer satisfying $2 \leq \alpha$, the method comprising:

displaying, on the predetermined pixel, an image corresponding to an average value of a gray scale level of the first pixel information and a gray scale level of the second pixel information so that the light reaches the first region in the display surface, in one subfield period within the first unit period and in another subfield period within the first unit period; and displaying, on the predetermined pixel, an image corresponding to an average value of a gray scale level of the second pixel information and a gray scale level of the third pixel information so that the light reaches the second region in the display surface, in one subfield period within the second unit period and in another subfield period within the second unit period, wherein:

the second pixel information indicating the second gray scale is respectively different from the first pixel information indicating the first gray scale and the third pixel information indicating the third gray scale, and the image corresponding to the second pixel information is displayed twice in a region where the first region and the second region in the display surface partially overlap, in the another subfield period within the first unit period and the one subfield period within the second unit period.

* * * * *